US006917341B2

(12) United States Patent
Ishihara et al.

(10) Patent No.: US 6,917,341 B2
(45) Date of Patent: Jul. 12, 2005

(54) TOP-LOADING MONOPOLE ANTENNA APPARATUS WITH SHORT-CIRCUIT CONDUCTOR CONNECTED BETWEEN TOP-LOADING ELECTRODE AND GROUNDING CONDUCTOR

(75) Inventors: Hirotaka Ishihara, Ibaraki (JP); Koichi Ogawa, Hirakata (JP); Susumu Inatsugu, Hirakata (JP); Tomoyuki Maeda, Kawanishi (JP); Atsushi Yamamoto, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 78 days.

(21) Appl. No.: 10/457,482

(22) Filed: Jun. 10, 2003

(65) Prior Publication Data

US 2004/0061652 A1 Apr. 1, 2004

(30) Foreign Application Priority Data

Jun. 11, 2002 (JP) ..... P2002-170159

(51) Int. Cl.[7] ..... H01Q 9/00
(52) U.S. Cl. ..... 343/752; 343/713
(58) Field of Search ..... 343/752, 711–713, 343/749, 828

(56) References Cited

U.S. PATENT DOCUMENTS

| | | | | |
|---|---|---|---|---|
| 4,635,068 A | | 1/1987 | Wheeler et al. | 343/749 |
| 5,181,044 A | | 1/1993 | Matsumoto et al. | 343/752 |
| 6,208,306 B1 | * | 3/2001 | McLean et al. | 343/747 |

FOREIGN PATENT DOCUMENTS

| | | |
|---|---|---|
| EP | 0 989 629 | 3/2000 |
| EP | 1 035 614 A2 | 9/2000 |
| EP | 1 035 614 | 9/2000 |
| JP | 04/286404 | 10/1992 |
| JP | 8-237025 | 9/1996 |
| JP | 10-242731 | 9/1998 |
| JP | 10-290113 | 10/1998 |
| JP | 2002-33616 | 1/2002 |
| JP | 2002-76751 | 3/2002 |
| JP | 2002-135025 | 5/2002 |
| WO | 98/43313 | 10/1998 |

OTHER PUBLICATIONS

Michael A. Morgan et al., "Eigenmode Analysis of Dielectric Loaded Top–Hat Monopole Antennas", IEEE Transaction on Antennas and Propagation, vol. 42, No. 1, pp. 54–61, Jan. 1994.

* cited by examiner

*Primary Examiner*—Shih-Chao Chen
(74) *Attorney, Agent, or Firm*—Wenderoth, Lind & Ponack, L.L.P.

(57) ABSTRACT

A top-loading monopole antenna apparatus having a feeding point is provided for use in a communication system such as a mobile communication system or the like. The top-loading monopole antenna apparatus includes a grounding conductor, a top-loading electrode, a linear conductor element, and a short-circuit conductor. The grounding conductor is provided so as to oppose the grounding conductor. The linear conductor element electrically connects the feeding point with the top-loading electrode, and the short-circuit conductor electrically connects the top-loading electrode through a reactive element. This antenna structure leads to a height which is lower than that of prior art, and easy impedance matching.

20 Claims, 31 Drawing Sheets

FIRST PREFERRED EMBODIMENT

FIRST PREFERRED EMBODIMENT

FIRST PREFERRED EMBODIMENT

SECOND PREFERRED EMBODIMENT

THIRD PREFERRED EMBODIMENT

FIRST MODIFIED PREFERRED EMBODIMENT OF THIRD PREFERRED EMBODIMENT

SECOND MODIFIED PREFERRED EMBODIMENT OF THIRD PREFERRED EMBODIMENT

FOURTH PREFERRED EMBODIMENT

MODIFIED PREFERRED EMBODIMENT OF FOURTH PREFERRED EMBODIMENT

FIFTH PREFERRED EMBODIMENT

FIRST MODIFIED PREFERRED EMBODIMENT OF FIFTH PREFERRED EMBODIMENT

SECOND MODIFIED PREFERRED EMBODIMENT OF FIFTH PREFERRED EMBODIMENT

SIXTH PREFERRED EMBODIMENT

MODIFIED PREFERRED EMBODIMENT OF SIXTH PREFERRED EMBODIMENT

SEVENTH PREFERRED EMBODIMENT

MODIFIED PREFERRED EMBODIMENT OF SEVENTH PREFERRED EMBODIMENT

EIGHTH PREFERRED EMBODIMENT

NINTH PREFERRED EMBODIMENT

TENTH PREFERRED EMBODIMENT

MODIFIED PREFERRED EMBODIMENT OF TENTH PREFERRED EMBODIMENT

ELEVENTH PREFERRED EMBODIMENT

MODIFIED PREFERRED EMBODIMENT OF ELEVENTH PREFERRED EMBODIMENT

TWELFTH PREFERRED EMBODIMENT

FIRST MODIFIED PREFERRED EMBODIMENT OF TWELFTH PREFERRED EMBODIMENT

SECOND MODIFIED PREFERRED EMBODIMENT OF TWELFTH PREFERRED EMBODIMENT

THIRTEENTH PREFERRED EMBODIMENT

FIRST MODIFIED PREFERRED EMBODIMENT OF THIRTEENTH PREFERRED EMBODIMENT

SECOND MODIFIED PREFERRED EMBODIMENT OF THIRTEENTH PREFERRED EMBODIMENT

THIRD MODIFIED PREFERRED EMBODIMENT OF THIRTEENTH PREFERRED EMBODIMENT

FIRST IMPLEMENTAL EXAMPLE

FIRST IMPLEMENTAL EXAMPLE

SECOND IMPLEMENTAL EXAMPLE

SECOND IMPLEMENTAL EXAMPLE

THIRD IMPLEMENTAL EXAMPLE

THIRD IMPLEMENTAL EXAMPLE

≒

FOURTEENTH PREFERRED EMBODIMENT

FIRST MODIFIED PREFERRED EMBODIMENT OF FOURTEENTH PREFERRED EMBODIMENT

SECOND MODIFIED PREFERRED EMBODIMENT OF FOURTEENTH PREFERRED EMBODIMENT

THIRD MODIFIED PREFERRED EMBODIMENT OF FOURTEENTH PREFERRED EMBODIMENT

FOURTH MODIFIED PREFERRED EMBODIMENT OF FOURTEENTH PREFERRED EMBODIMENT

FOURTH MODIFIED PREFERRED EMBODIMENT OF THIRTEENTH PREFERRED EMBODIMENT

FIFTH MODIFIED PREFERRED EMBODIMENT OF THIRTEENTH PREFERRED EMBODIMENT

SIXTH MODIFIED PREFERRED EMBODIMENT OF THIRTEENTH PREFERRED EMBODIMENT

TOP-LOADING MONOPOLE ANTENNA APPARATUS WITH SHORT-CIRCUIT CONDUCTOR CONNECTED BETWEEN TOP-LOADING ELECTRODE AND GROUNDING CONDUCTOR

TITLE OF THE INVENTION

Top-Loading Monopole Antenna Apparatus with Short-Circuit Conductor Connected between Top-loading Electrode and Grounding Conductor

BACKGROUND OF THE INVENTION

1. Field of the Invention

The present invention relates to a top-loading monopole antenna apparatus for use in a communication system such as a mobile communication system or the like, and to a communication system and a mobile communication system which each have the same top-loading monopole antenna apparatus. In particular, the present invention relates to a top-loading monopole antenna apparatus including a short-circuit conductor which is electrically connected through a reactive element between a top-loading electrode and a grounding conductor, and to a communication system and a mobile communication system which each have the same top-loading monopole antenna apparatus.

2. Description of the Related Art

A top-loading monopole antenna apparatus has been widely and generally used as an antenna for use in a vehicle. The top-loading monopole antenna apparatus generally includes a linear antenna element, and the length thereof is often set to ¼ wavelength or ¾ wavelength. In the case of a frequency of 900 MHz for use in portable telephones, the ¼ wavelength is 83 mm, and the ¾ wavelength is 249 mm. In this case, the size thereof is too large as an antenna apparatus which is placed on a roof of a vehicle or on the inside of the vehicle. Accordingly, a top-loading monopole antenna apparatus as a low-profile monopole antenna apparatus has been developed.

FIG. 39 is a perspective view showing a structure of a top-loading monopole antenna apparatus of the prior art. The top-loading monopole antenna apparatus is constituted by including the following:

(a) a circular flat-plate-shaped top-loading electrode 11 (hereinafter referred to as an electrode 11);

(b) a circular flat-plate-shaped grounding conductor 14 that is provided so as to oppose the electrode 11 and has a feeding point 35 in the center thereof; and (c) a linear conductor element 12 that electrically connects the center of the electrode 11 with the feeding point 35; and (d) a short-circuit conductor 13 that electrically connects a point on the electrode 11 which is different from the center of the electrode 11 with the grounding conductor 14.

In this case, a central conductor of a coaxial cable 30 for feeding electric power or transmitting a RF signal is electrically connected with the feeding point 35, and a grounding conductor of the coaxial cable 30 is electrically connected with the grounding conductor 14.

The top-loading monopole antenna apparatus of the prior art is constituted by connecting the circular flat-plate-shaped electrode 11 with a top portion of a top-loading monopole antenna apparatus. By employing the circular flat-plate-shaped electrode 11, the top-loading monopole antenna apparatus, for which a height (length) of 83 mm was required at ¼ wavelength in the case of a frequency of 900 MHz, is allowed to have a low-profile configuration of a height of 30 to 40 mm.

Next, the problems of the prior art, which are attempted to be solved by the present invention, will be described hereinbelow.

A first problem of the prior art relates to impedance matching between the antenna apparatus and the coaxial cables 30 for feeding electric power or transmitting a RF signal. When the number of the short-circuit conductors 13 is increased, the top-loading monopole antenna apparatus can control the input impedance of the antenna apparatus. However, this leads to such a problem that the resonance frequency of the antenna apparatus, and then, failing in achieving impedance matching at a lower frequency.

A second problem of the prior art relates to the size of the circular flat-plate-shaped electrode 11. If the top-loading monopole antenna apparatus is made to have a low-profile configuration, the size of the circular flat-plate-shaped electrode 11 is then required to be increased. This is undesirable from the viewpoint of size reduction. The reason for the need to increase the size of the circular flat-plate-shaped electrode 11 will be described hereinbelow with reference to FIG. 40, which is a longitudinal sectional view showing currents flowing in the top-loading monopole antenna apparatus of FIG. 39.

Referring to FIG. 40 showing the top-loading monopole antenna apparatus of FIG. 39, a current 21 flows in the linear conductor element 12 from the linear conductor element 12 toward the circular flat-plate-shaped electrode 11, and the current 21 flows in the electrode 11 from the center portion of the electrode 11 toward the edge portions thereof as indicated by the current 22 so as to be parallel to the grounding conductor 14. In this case, the electric field distribution of the antenna apparatus can be considered as a sum of electric fields which are caused by the current 21, the current 22 and an image current 23 which is reverse to the current 22. The image current 23 is not an actually existing current but is a current for obtaining an equivalent electric field distribution assuming that the grounding conductor 14 does not exist in the monopole antenna apparatus. In this case, a distance between the current 22 and the image current 23 is double the distance between the circular flat-plate-shaped electrode 11 and the grounding conductor 14. That is, it can be assumed that the image current 23 corresponding to the current 22 flows axisymmetrically with respect to the grounding conductor 14.

Making the top-loading monopole antenna apparatus have a low profile is to shorten the distance between the circular flat-plate-shaped electrode 11 and the grounding conductor 14. At this time, the distance between the current 22 and image current 23 is also shortened. The electric field that is caused by the current 22 and the electric field that is caused by the image current 23 are reverse to each other, and therefore, mutually canceling electric fields increase as the distance decreases. Due to compensation for the canceled electric fields, the current 21 flowing in the linear conductor element 12 and the current 22 flowing in the circular flat-plate-shaped electrode 11 increase. In this case, in order to maintain the input impedance constant, it is necessary to provide an increase in the resistance component for the increase in the current. Therefore, to increase the resistance component, the size of the circular flat-plate-shaped electrode 11 is increased.

A third problem of the prior art relates to the usable band. If the height of the antenna apparatus is lowered, then the bandwidth is narrowed. There is such a problem that the bandwidth used by the application to use the antenna apparatus is predetermined, and this leads to a limitation on the ability to lower the height of the antenna apparatus.

A fourth problem of the prior art relates to providing an antenna apparatus in a vehicle. An antenna apparatus which is provided in a vehicle should preferably have, in particular, a compact configuration. If an ordinary top-loading monopole antenna apparatus is made to have a low-profile antenna configuration as described above, then the size of the circular flat-plate-shaped electrode 11 increases, and the required size of the grounding conductor 14 also increases. It is often the case where a sufficient size of the grounding conductor 14 cannot be secured in a vehicle, and accordingly, there is also a limitation on the height of the antenna apparatus made to have a low-profile configuration. The height of the top-loading monopole antenna apparatus of the prior art becomes 30 to 40 mm due to the restriction on the size of the grounding conductor 14, and it has been unsuitable for use in a vehicle.

SUMMARY OF THE INVENTION

An essential object of the present invention is therefore to solve the above-mentioned problems, to provide a top-loading monopole antenna apparatus which is capable of being constituted with a height that is lower than that of the prior art and which is capable of achieving easy impedance matching, and also to provide a communication system or a mobile communication system which is provided with the top-loading monopole antenna apparatus.

Another object of the present invention is to solve the above-mentioned problems, to provide a top-loading monopole antenna apparatus which is capable of being constituted with a height that is lower than that of the prior art and which is capable of preventing an increase in the size of the top-loading electrode, and also to provide a communication system or a mobile communication system which is provided with the top-loading monopole antenna apparatus.

A further object of the present invention is to solve the above-mentioned problems, to a top-loading monopole antenna apparatus which is capable of being constituted with a height that is lower than that of the prior art and which is capable of having a wider bandwidth, and also to provide a communication system or a mobile communication system which is provided with the top-loading monopole antenna apparatus.

Furthermore, a still further object of the present invention is to solve the above-mentioned problems, to provide a top-loading monopole antenna apparatus which is capable of being reduced in size and weight further than those of the prior art and which is suitable for being installed in a mobile body, and also to provide a communication system or a mobile communication system which is provided with the top-loading monopole antenna apparatus.

In order to achieve the above-mentioned objects, according to one aspect of the present invention, there is provided a top-loading monopole antenna apparatus having a feeding point. The top-loading monopole antenna apparatus includes a grounding conductor, a top-loading electrode, a linear conductor element, and a short-circuit conductor. The top-loading electrode is provided so as to oppose the grounding conductor, the linear conductor element electrically connects the feeding point with the top-loading electrode, and the short-circuit conductor electrically connects the top-loading electrode through a first reactive element.

According to another aspect of the present invention, there is provided a top-loading monopole antenna apparatus having a feeding point. The top-loading monopole antenna apparatus includes a grounding conductor, a top-loading electrode, a linear conductor element, and a short-circuit conductor. The top-loading electrode is provided so as to oppose the grounding conductor, the linear conductor element electrically connects the feeding point with the top-loading electrode through a second reactive element, and the short-circuit conductor electrically connects the top-loading electrode with the grounding conductor.

According to a further aspect of the present invention, there is provided a top-loading monopole antenna apparatus having a feeding point. The top-loading monopole antenna apparatus includes a grounding conductor, a top-loading electrode, a linear conductor element, and a short-circuit conductor. The top-loading electrode is provided so as to oppose the grounding conductor, the short-circuit conductor electrically connects the top-loading electrode with the grounding conductor through a first reactive element, and the linear conductor element electrically connects the feeding point with the top-loading electrode through a second reactive element.

In the above-mentioned top-loading monopole antenna apparatus, the grounding conductor preferably has a shape of a circular flat plate.

In the above-mentioned top-loading monopole antenna apparatus, the top-loading electrode preferably has a shape of a circular flat plate.

The above-mentioned top-loading monopole antenna apparatus preferably further includes a movable top-loading electrode which is movably provided so as to change an effective area of the top-loading electrode and the movable top-loading electrode. The movable further top-loading electrode is electrically connected with the top-loading electrode.

The above-mentioned top-loading monopole antenna apparatus preferably further includes a first short-circuit control conductor for electrically connecting an intermediate position that is located between both ends of the linear conductor element with the grounding conductor.

The above-mentioned top-loading monopole antenna apparatus preferably further includes a second short-circuit control conductor for electrically connecting an intermediate position that is located between both ends of the short-circuit conductor with the grounding conductor.

The above-mentioned top-loading monopole antenna apparatus preferably further includes a first parasitic element which is provided so as to be parallel to the linear conductor element and the short-circuit conductor, and the first parasitic element has one end which is electrically connected with the grounding conductor.

The above-mentioned top-loading monopole antenna apparatus preferably further includes a plurality of first parasitic elements provided so as to be parallel to the linear conductor element and the short-circuit conductor, and each of the first parasitic elements has one end which is electrically connected with the grounding conductor.

The above-mentioned top-loading monopole antenna apparatus preferably further includes a second parasitic element which is provided at a position that is located apart by a predetermined distance from an outer edge portion of the top-loading electrode so that a part of the second parasitic element extends along the outer edge portion of the top-loading electrode, and one end of the second parasitic element is electrically connected with the grounding conductor.

In the above-mentioned top-loading monopole antenna apparatus, the part of the second parasitic element along the outer edge portion of the top-loading electrode preferably has a length of ¼ wavelength at an operating center frequency of the top-loading monopole antenna apparatus.

The above-mentioned top-loading monopole antenna apparatus preferably further includes a third parasitic element, and the third parasitic element is provided at a position that is located apart by a predetermined distance from an outer edge portion of the top-loading electrode so as to extend along the outer edge portion thereof.

In the above-mentioned top-loading monopole antenna apparatus, the third parasitic element preferably has a length of ½ wavelength at an operating center frequency of the top-loading monopole antenna apparatus. The above-mentioned top-loading monopole antenna apparatus preferably further includes at least one of a set of the plurality of second parasitic elements, and a set of the plurality of third parasitic elements.

In the above-mentioned top-loading monopole antenna apparatus, at least one of the first reactive element and the second reactive element preferably includes a variable capacitance diode, and the top-loading monopole antenna apparatus further includes a voltage control circuit for generating and applying a bias voltage to the variable capacitance diode.

In the above-mentioned top-loading monopole antenna apparatus, at least one of the first reactive element and the second reactive element preferably includes a switching diode, and the top-loading monopole antenna apparatus further includes a voltage control circuit for generating and applying a bias voltage to the switching diode.

In the above-mentioned top-loading monopole antenna apparatus, the top-loading electrode preferably has a shape having a curved cross-section.

According to a still further aspect of the present invention, there is provided a communication system including a radio receiver, and the above-mentioned top-loading monopole antenna apparatus, where the top-loading monopole antenna apparatus is electrically connected with the radio receiver.

According to another aspect of the present invention, there is provided a mobile communication system including a radio receiver which is provided in a mobile body, and the top-loading monopole antenna apparatus, where the top-loading monopole antenna apparatus is provided on at least one of the inside and outside of the mobile body and is electrically connected with the radio receiver.

In the above-mentioned mobile communication system, when the top-loading monopole antenna apparatus is provided in the vicinity of either one of a front window and a rear window of the mobile body, the top-loading monopole antenna apparatus is preferably provided so that the short-circuit conductor of the top-loading monopole antenna apparatus is provided so as to be closer to the one of the front window and the rear window than the linear conductor element.

The above-mentioned mobile communication system preferably includes two of the top-loading monopole antenna apparatuses being provided in the mobile body. In this case, one of the top-loading monopole antenna apparatuses is provided so that the short-circuit conductor of the one monopole antenna apparatus is closer to the front window than the linear conductor element, and another one of the top-loading monopole antenna apparatus is provided so that the short-circuit conductor of the another one of the top-loading monopole antenna apparatus is closer to the front window than the linear conductor element.

The above-mentioned mobile communication system preferably includes four of the top-loading monopole antenna apparatuses being provided in the mobile body. In this case, two of the top-loading monopole antenna apparatuses are provided so that the short-circuit conductors of the two of monopole antenna apparatuses are closer to the front window than the linear conductor elements, respectively, and the other two of the top-loading monopole antenna apparatuses are provided so that the short-circuit conductors of the other two of the top-loading monopole antenna apparatuses are closer to the front window than the linear conductor elements, respectively.

In the above-mentioned mobile communication system, a recess portion preferably is formed in the mobile body, and the top-loading monopole antenna apparatus is provided in the recess portion, where an opening of the recess portion is covered with a radome.

According to still another aspect of the present invention, there is provided a top-loading monopole antenna apparatus having a feeding point, a first top-loading electrode, a linear feeding element, a second top-leading element, and a linear parasitic element. The first top-loading electrode is provided so as to oppose a grounding conductor, and the linear feeding element electrically connects the feeding point with the first top-loading electrode. The second top-loading electrode is provided so as to oppose the grounding conductor, and the linear parasitic element electrically connects the feeding point with the second top-loading electrode. In this case, the first top-loading electrode and the second top-loading electrode are provided adjacently so as to be electromagnetically coupled to each other.

The above-mentioned top-loading monopole antenna apparatus preferably further includes at least one reactive element which is inserted at at least one of a connection point between the linear parasitic element and the first top-loading electrode and a connection point between the linear parasitic element and the second top-loading electrode.

The above-mentioned top-loading monopole antenna apparatus preferably further includes a parasitic element having one end which is opened and another end which is electrically connected with the grounding conductor.

The above-mentioned top-loading monopole antenna apparatus preferably further includes a short-circuit control element having one end which is electrically connected with the linear parasitic element and another end which is electrically connected with the grounding conductor.

The above-mentioned top-loading monopole antenna apparatus preferably further includes at least one further second top-loading electrode and at least one further linear parasitic element. The at least one further second top-loading electrode is provided so as to oppose to the grounding conductor, and the at least one further linear parasitic element electrically connects the feeding point with the further second top-loading electrode. In this case, the first top-loading electrode and the further second top-loading electrode are provided adjacently so as to be electromagnetically coupled to each other.

In the above-mentioned top-loading monopole antenna apparatus, the first reactive element preferably includes any one of the following: (a) one capacitor, (b) one inductor, (c) a parallel circuit of a capacitor and an inductor, and (d) a series circuit of a capacitor and an inductor.

In the above-mentioned top-loading monopole antenna apparatus, the second reactive element preferably includes any one of the following: (a) one capacitor, (b) one inductor, (c) a parallel circuit of a capacitor and an inductor, and (d) a series circuit of a capacitor and an inductor.

In the above-mentioned top-loading monopole antenna apparatus, the reactive element preferably includes any one of the following: (a) one capacitor, (b) one inductor, (c) a parallel circuit of a capacitor and an inductor, and (d) a series circuit of a capacitor and an inductor.

According to a further aspect of the present invention, there is provided a communication system including a radio receiver, and the above-mentioned top-loading monopole antenna apparatus. In this case, the top-loading monopole antenna apparatus is electrically connected with the radio receiver.

According to a still further aspect of the present invention, there is provided a mobile communication system including a radio receiver which is provided in a mobile body, and the above-mentioned top-loading monopole antenna apparatus. In this case, the top-loading monopole antenna apparatus is provided on at least one of an inside and outside of the mobile body and is electrically connected with the radio receiver.

In the above-mentioned mobile communication system, the mobile body is preferably either one of a vehicle, a ship and an airplane.

BRIEF DESCRIPTION OF THE DRAWINGS

These and other objects and features of the present invention will be clear from the following description taken in conjunction with the preferred embodiments thereof with reference to the accompanying drawings throughout which like parts are designated by like reference numerals, and in which.

DETAILED DESCRIPTION OF THE PREFERRED EMBODIMENTS

Figure 1A:
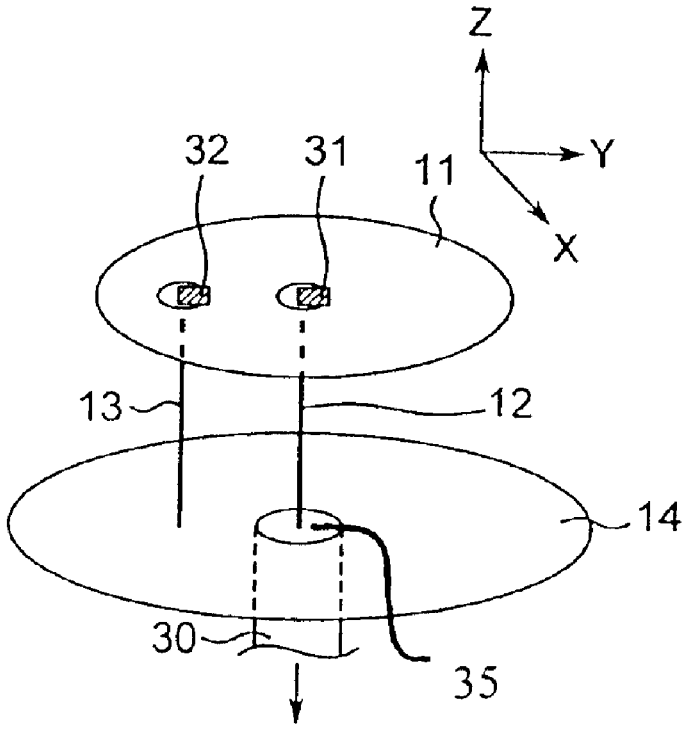
FIG. 1A is a perspective view showing a structure of a top-loading monopole antenna apparatus according to a first preferred embodiment of the present invention.

Preferred embodiments of the present invention will be described below with reference to the drawings. It is to be noted that similar components are denoted by the same reference numerals in the drawings, respectively.

First Preferred Embodiment

Figure 1B:
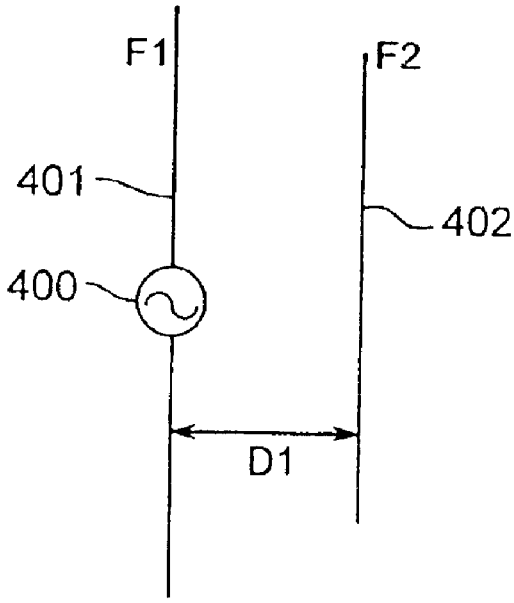
FIG. 1B is a schematic view showing a prototype or original antenna apparatus which is equivalent to the top-loading monopole antenna apparatus of FIG. 1A.

FIG. 1A is a perspective view showing a structure of a top-loading monopole antenna apparatus according to the first preferred embodiment of the present invention, and FIG. 1B is a schematic view showing a prototype or original antenna apparatus which is equivalent to the top-loading monopole antenna apparatus of FIG. 1A. The top-loading monopole antenna apparatus of the first preferred embodiment provides means for solving the first problem of the prior art concerning the above-mentioned impedance matching, and the structure of the present antenna apparatus will be described hereinbelow with reference to FIGS. 1A and 1B.

Figure 39:
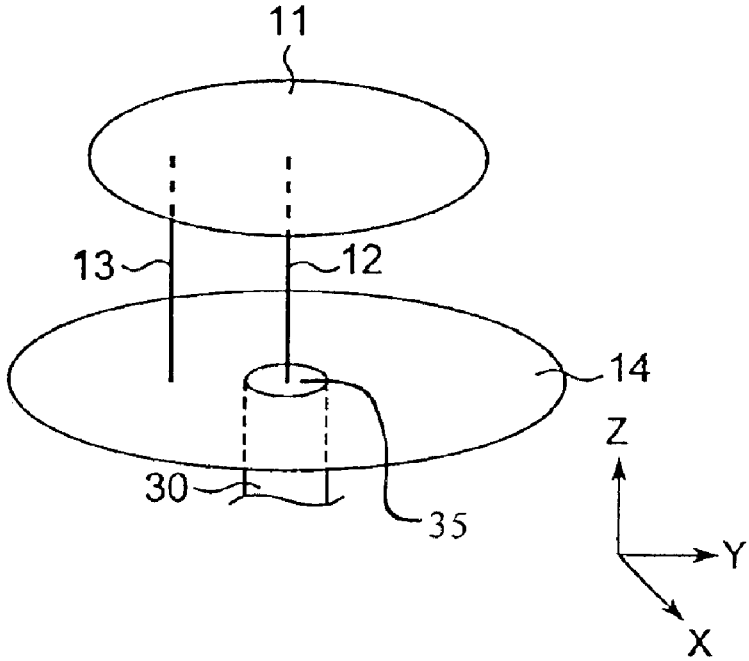
Fig.39 PRIOR ART
FIG. 39 is a perspective view showing a structure of a top-loading monopole antenna apparatus according to the prior art.
Figure 40:
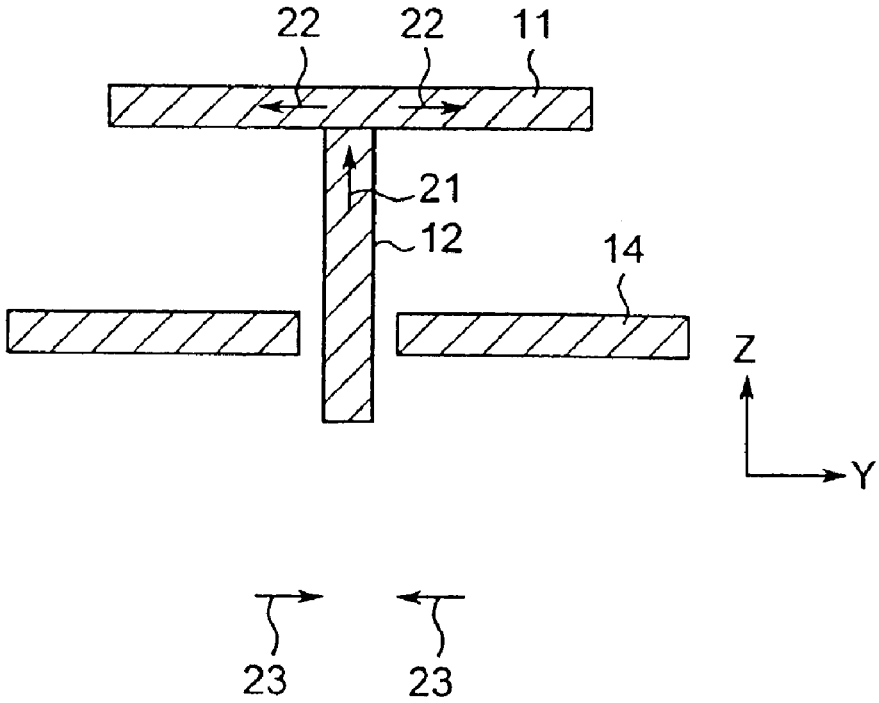
Fig.40 PRIOR ART
FIG. 40 is a longitudinal sectional view showing currents flowing in the top-loading monopole antenna apparatus of FIG. 39.

The top-loading monopole antenna apparatus of the first preferred embodiment shown in FIG. 1A is characterized as being different from the top-loading monopole antenna apparatus of the prior art shown in FIG. 39 at least with respect to the following points.

(1) One end of the linear conductor element 12 on the side of a top-loading electrode 11 (hereinafter referred to as an electrode 11 in a manner similar to that of the prior art) is electrically connected with the electrode 11 through a reactive element 31. Specifically, as shown in FIG. 1A, a circular hole is formed in the center of the electrode 11. The one end of the linear conductor element 12 on the side of the electrode 11 is electrically connected with one end of the reactive element 31, and another end of the reactive element 31 is electrically connected with the electrode 11.

(2) One end of the short-circuit conductor 13 on the side of the electrode 11 is electrically connected with the electrode 11 through a reactive element 32. Specifically, as shown in FIG. 1A, a circular hole is formed at a position that is located apart from the center of the electrode 11. The one end of the short-circuit conductor 13 on the side of the electrode 11 is electrically connected with one end of the reactive element 32, and another of the reactive element-32 is electrically connected with the electrode 11.

Referring to FIG. 1A, the top-loading monopole antenna apparatus of the first preferred embodiment is constituted by comprising:

(a) the circular flat-plate-shaped electrode 11 for providing top-loading;

(b) a circular flat-plate-shaped grounding conductor 14 provided so as to oppose the electrode 11 and having a feeding point 35 in the center thereof;

(c) a linear conductor element 12 that electrically connects the center of the electrode 11 with the feeding point 35 through the reactive element 31; and (d) a short-circuit conductor 13 that electrically connects a point on the electrode 11 which is different from the center of the electrode 11 with the grounding conductor 14 through the reactive element 32.

In this case, a central conductor of a coaxial cable 30 for feeding electric power or transmitting a RF signal is electrically connected with the feeding point 35, and a grounding conductor of the coaxial cable 30 is electrically connected with the grounding conductor 14. The longitudinal direction of the linear conductor element 12 and the short-circuit conductor 13 is perpendicular to the flat-plate surfaces of the grounding conductor 14 and the electrode 11.

In the first preferred embodiment, since the electrode 11 is electrically connected with the grounding conductor 14 through the reactive element 32, the electrical radius of the electrode 11 is changed by the reactance of the reactive element 32, and becomes equal to ¼ wavelength to ⅙ wavelength. Moreover, the electrical radius of the grounding conductor 14 is preferably set to ½ wavelength or lower. Furthermore, the length of the linear conductor element 12 and the short-circuit conductor 13, i.e., the height of the antenna apparatus is ¼ wavelength in the prior art, whereas the length of the linear conductor element 12 and the short-circuit conductor 13 is ⅛ wavelength to 1/10 wavelength in the first preferred embodiment. It is to be noted that one wavelength is a length corresponding to the operating center frequency at which the present antenna apparatus operates in the first preferred embodiment and various preferred embodiments and modified preferred embodiments which will be described later.

Figure 41A:
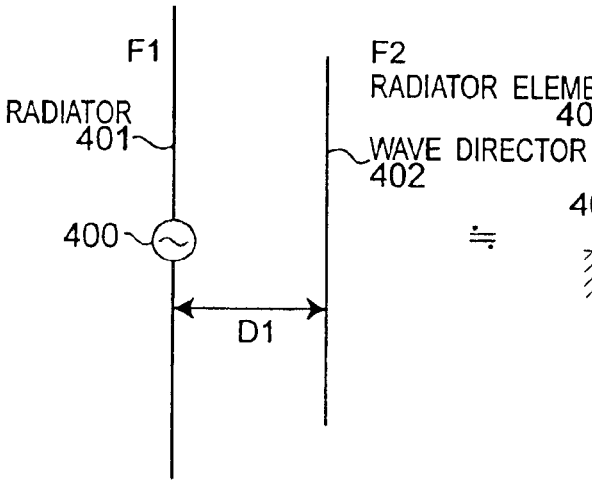
FIG. 41A is a schematic view of the prototype or original antenna apparatus of FIG. 1A having a structure shown in FIG. 1B.

The principle of operation of the top-loading monopole antenna apparatus of FIGS. 1A and 1B constituted as described above will be described below with reference to FIGS. 41 and 42. FIG. 41A is a schematic view of the prototype or original antenna apparatus of FIG. 1A having a structure shown in FIG. 1B, and FIG. 41B is a schematic view of an antenna apparatus which is equivalent to the antenna apparatus of FIG. 41A.

Referring to FIGS. 1B and 41A, the prototype of the top-loading monopole antenna apparatus of FIG. 1A is constituted by comprising a radiator 401 of a half-wavelength dipole antenna element which is excited by a RF signal from a signal source 400 of a transmitter and a wave director 402 that are located apart from each other by a distance D1. In this case, it is assumed that the resonance frequency of the radiator 401 is F1 and that the resonance frequency of the wave director 402 is F2. It is known that, when the value of the distance D1 is variously changed, the gain of the antenna apparatus becomes maximized, for example, for $D1 \approx 0.15\lambda$ to $0.25\lambda$, and further, for $D1 \approx 0.05\lambda$ to $0.1\lambda$, the antenna apparatus has two resonance frequencies, and the input impedance of the antenna apparatus becomes an optimum value (e.g., 50Ω).

Figure 41B:
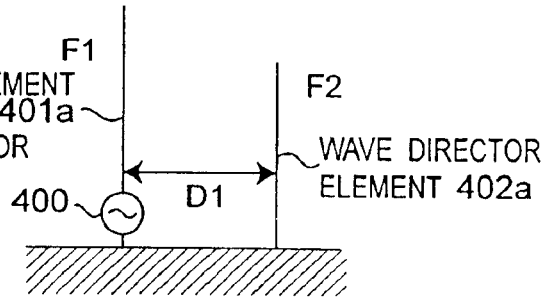
FIG. 41B is a schematic view of an antenna apparatus which is equivalent to the antenna apparatus of FIG. 41A.
Figure 42A:
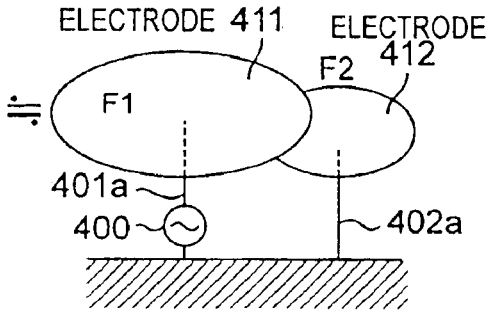
FIG. 42A is a schematic view of an antenna apparatus which is equivalent to the antenna apparatus of FIG. 41B.
Figure 42B:
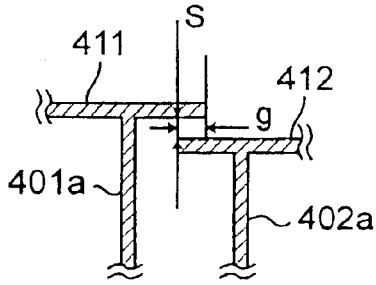
FIG. 42B is a longitudinal sectional view of a mutually adjacent position between two electrodes 411 and 412 of the antenna apparatus of FIG. 42A.
Figure 42C:
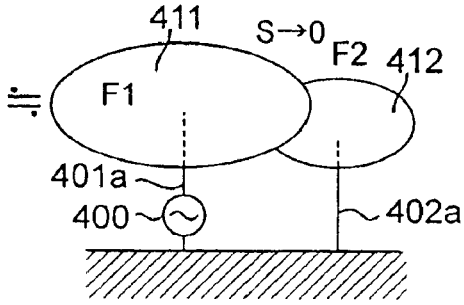
FIG. 42C is a schematic view of an antenna apparatus which is equivalent to the antenna apparatus of FIG. 42A.
Figure 42D:
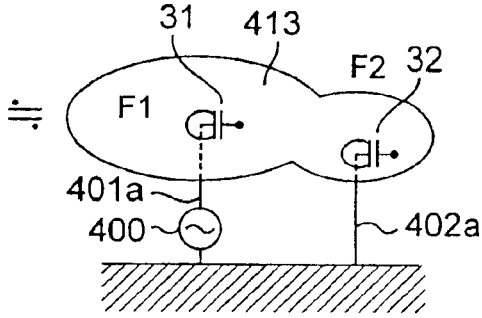
FIG. 42D is a schematic view of an antenna apparatus which is equivalent to the antenna apparatus of FIG. 42C.
Figure 42E:
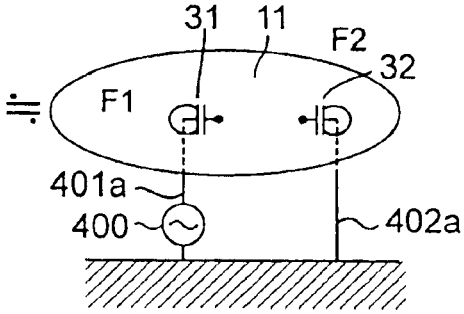
FIG. 42E is a schematic view of an antenna apparatus which is equivalent to the antenna apparatus of FIG. 42D.
Figure 42F:
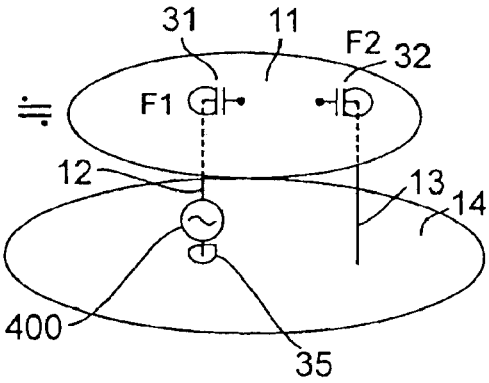
FIG. 42F is a schematic view of an antenna apparatus which is equivalent to the antenna apparatus of FIG. 42E.

FIG. 42A is a schematic view of an antenna apparatus which is equivalent to the antenna apparatus of FIG. 41B. FIG. 42B is a longitudinal sectional view of a mutually adjacent position between two electrodes 411 and 412 in the antenna apparatus of FIG. 42A. FIG. 42C is a schematic view of an antenna apparatus which is equivalent to the antenna apparatus of FIG. 42A. FIG. 42D is a schematic view of an antenna apparatus which is equivalent to the antenna apparatus of FIG. 42C. FIG. 42E is a schematic view of an antenna apparatus which is equivalent to the antenna apparatus of FIG. 42D. FIG. 42F is a schematic view of an antenna apparatus which is equivalent to the antenna apparatus of FIG. 42E. Hereinafter, FIG. 41A is assumed to be a prototype or original antenna apparatus, and it will be described that the top-loading monopole antenna apparatus of FIG. 1A can be obtained by a substitutional transformation of the antenna apparatus into the equivalent models of FIG. 42F through FIG. 41B and FIGS. 42A to 42E.

FIG. 41B shows an antenna apparatus when the balanced type Yagi antenna of FIG. 41A is expressed by an unbalanced type equivalent model having a grounding conductor (grounding plate), and the antenna apparatus of FIG. 41B is constituted by comprising a radiator element 401*a* having a resonance frequency F1 and a wave director element 402*a* having a resonance frequency F2. In this case, if an image is conversely considered by assuming the grounding conductor as an axis of symmetry in the antenna apparatus of FIG. 41B, then the antenna apparatus of FIG. 41A can be obtained.

Next, the antenna apparatus of FIG. 42A is obtained by adding an electrode 411 to the tip of the radiator element 401*a* that is a linear conductor element in the antenna apparatus of FIG. 41B, by adding an electrode 412 to the tip of the wave director element 402*a* that is a linear conductor element, and by making these electrodes 411 and 412 serve as top-loading elements. In this case, a longitudinal sectional view of a mutually adjacent position between the electrodes 411 and 412 of the top-loading elements is shown in FIG. 42B. In FIG. 42B, "S" represents an interval in the vertical direction between the two electrodes 411 and 412, and "g" represents a length of an overlapped portion in the horizontal direction between the two electrodes 411 and 412. As is apparent from FIGS. 42A and 42B, by changing the interval "S" and the length "g" of the overlapped portion, electromagnetic coupling between the radiator element 401*a* and the wave director element 402*a* can be adjusted.

Next, referring to FIG. 42C, if the interval "S" approaches zero and finally being that "S"=0, then there is one electrode 413 which is constituted by comprising the two top-loading electrodes 411 and 412, as shown in FIG. 42D. In this case, when the two electrodes 411 and 412 are constituted by comprising one electrode 413 as shown in FIG. 42D (one electrode 11 as shown in FIGS. 42E and 42F), it is necessary to adjust the influence of the electromagnetic coupling between the two electrodes 411 and 412 in the top-loading section which is exerted on the factor of the radiator element 401*a* and the factor of the wave director element 402*a* by the reactive elements 31 and 32. Therefore, in FIGS. 42D, 42E and 42F, the reactive element 31 is inserted between the tip of the radiator element 401*a* and the electrode 413 or 11, and the reactive element 32 is inserted between the tip of the wave director element 402*a* and the electrode 413 or 11. Moreover, a gourd-shaped electrode 413, as shown in FIG. 42D, is changed into a circular electrode 11 as shown in FIG. 42E. By executing model transformation of the antenna apparatus as described above, the top-loading monopole antenna apparatus shown in FIGS. 42F and 1A can be obtained. It is to be noted that the grounding conductor 14 has a finite size in FIGS. 42F and 1A.

As described above, the schematic views of the antennas of FIGS. 41A, 41B, 42A, 42B, 42C, 42D, 42E and 42F show a replacement of the antenna apparatuses with the equivalent models. It can be understood from these results that the antenna apparatus of the first preferred embodiment of the present invention of FIG. 1A is equivalent to the prototype or original antenna apparatus of FIG. 1B, and utilizes the resonance frequencies F1 and F2 of the two top-loading monopole antenna elements.

Figure 2:
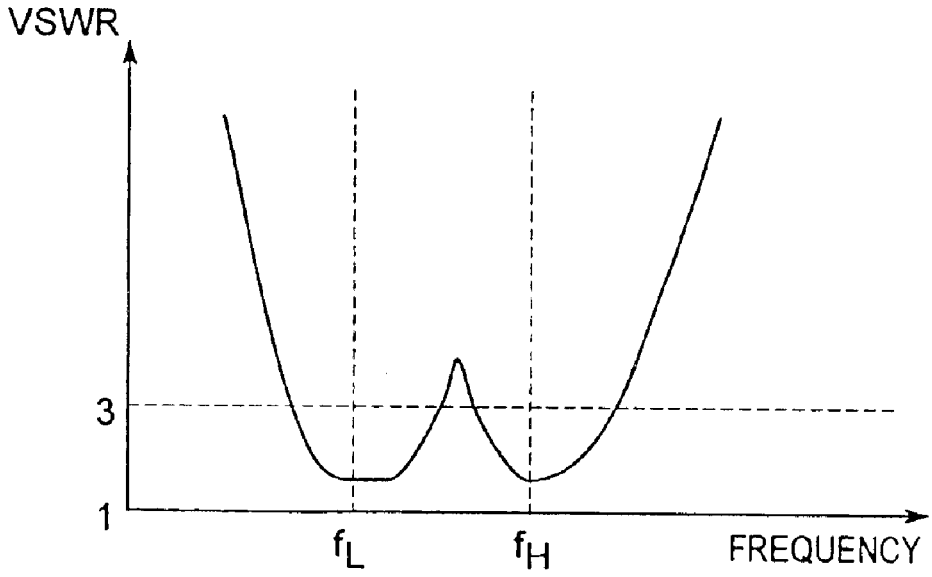
FIG. 2 is a graph showing a frequency characteristic of the VSWR (voltage standing wave ratio) of the top-loading monopole antenna apparatus of FIG. 1A.

FIG. 2 is a graph showing a frequency characteristic of the voltage standing wave ratio (hereinafter referred to as VSWR) of the top-loading monopole antenna apparatus of FIG. 1A. In this case, when the antenna apparatus has two resonance frequencies $f_L$ and $f_H$ ($f_H>f_L$), the two resonance frequencies $f_L$ and $f_H$ are located at the respective bottom points of two curve portions (local minimum points) when the VSWR draws downward curves as shown in FIG. 2.

In the first preferred embodiment, impedance matching between the coaxial cable 30 for feeding electric power or transmitting a RF signal, and the antenna apparatus is determined by a relationship between these two resonance frequencies $f_H$ and $f_L$. That is, there is the short-circuit conductor 13 in the top-loading monopole antenna apparatus of the prior art, however, impedance matching can not be achieved with a low-profile configuration. This is because a frequency difference between the two resonance frequencies $f_H$ and $f_L$ is excessively large. In contrast to this, in the first preferred embodiment, the two resonance frequencies $f_H$ and $f_L$ can be controlled by adding the reactive elements 31 and 32 and by adjusting the respective capacitance values thereof.

Figure 43:
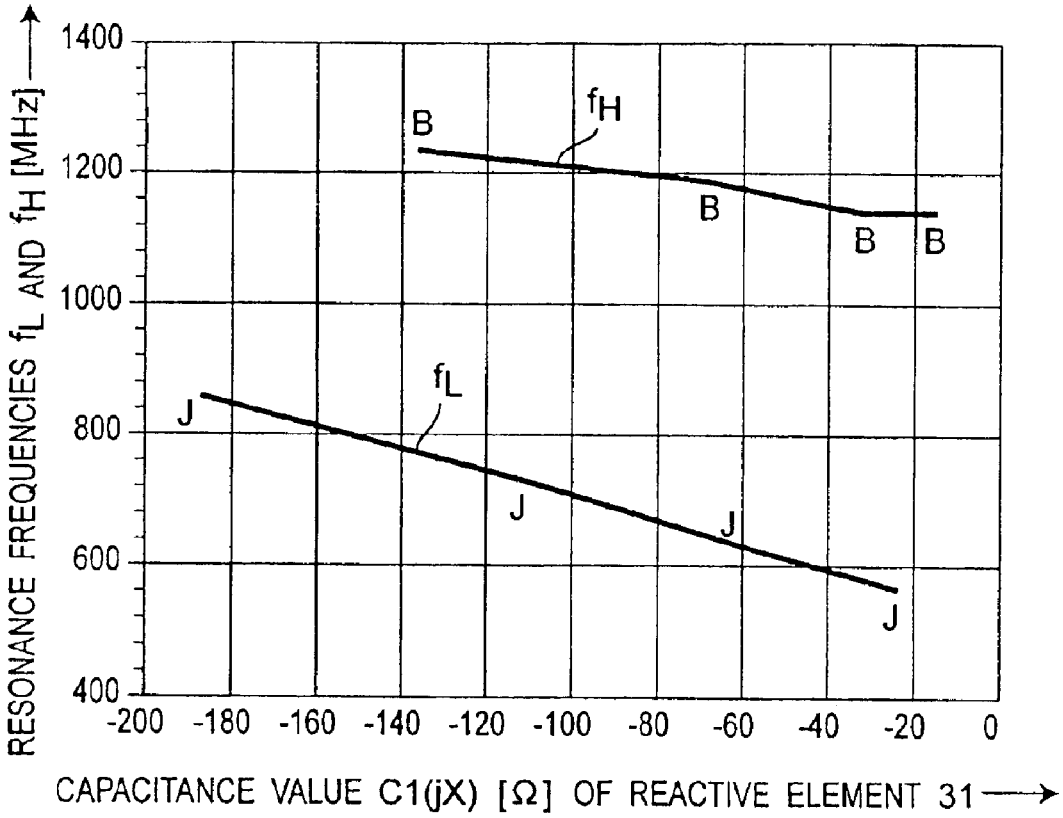
FIG. 43 is a graph showing changes in resonance frequencies $f_L$ and $f_H$ when a capacitance value C1 of a reactive element 31 of the top-loading monopole antenna apparatus of FIG. 1A is changed.
Figure 44:
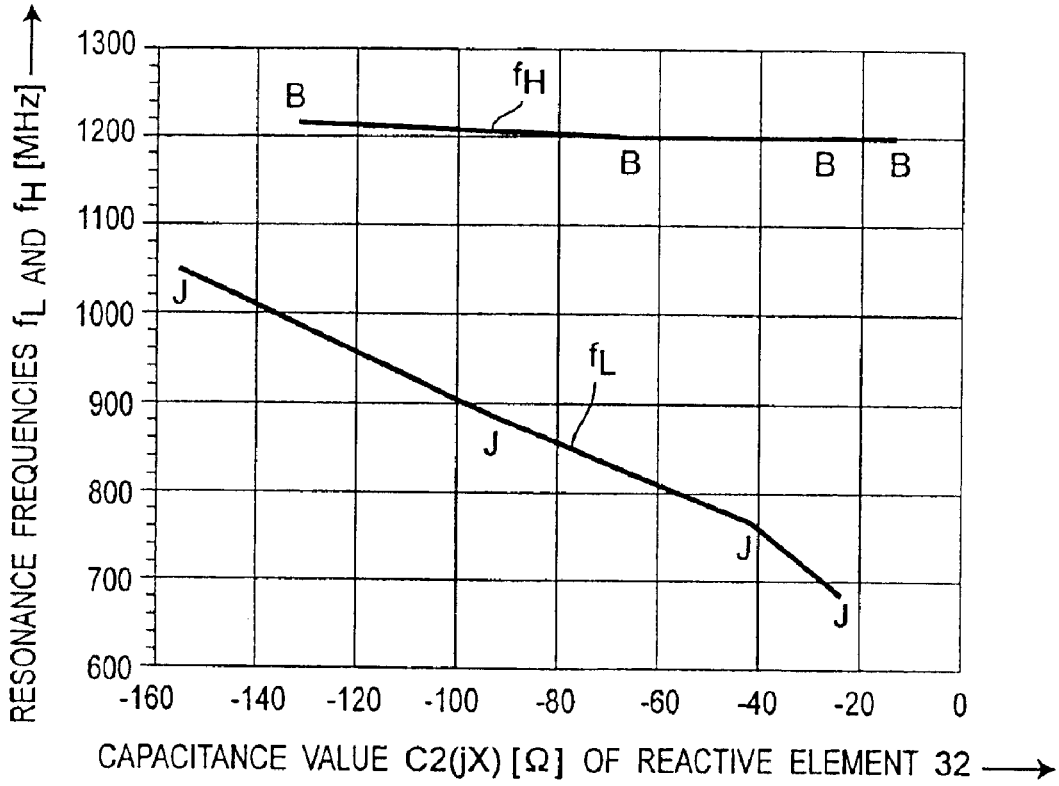
FIG. 44 is a graph showing changes in the resonance frequencies $f_L$ and $f_H$ when a capacitance value C2 of a reactive element 32 of the top-loading monopole antenna apparatus of FIG. 1A is changed.

FIG. 43 is a graph showing changes in the resonance frequencies $f_L$ and $f_H$ when a capacitance value C1 of the reactive element 31 of the top-loading monopole antenna apparatus of FIG. 1A is changed. FIG. 44 is a graph showing changes in the resonance frequencies $f_L$ and $f_H$ when a capacitance value C2 of the reactive element 32 of the top-loading monopole antenna apparatus of FIG. 1A is changed. In this case, one capacitor is used as each of the reactive elements 31 and 32. The electrode 11 have a circular shape of a diameter of 50 mm, and an antenna height from the grounding conductor 14 to the electrode 11 is set to 30 mm. When the capacitance value C1 of the reactive element 31 is changed, the capacitance value C2 of the reactive element 32 is fixed to 1 pF. Further, when the capacitance value C2 of the reactive element 32 is changed, the capacitance value C1 of the reactive element 31 is fixed to 0.5 pF.

As is apparent from FIG. 43, it can be understood that the two resonance frequencies $f_H$ and $f_L$ can be changed by changing the capacitance value C1 of the reactive element 31. Moreover, as is apparent from FIG. 44, it can be understood that the resonance frequency $f_L$ on the side of the lower frequency can be changed by changing the capacitance value C2 of the reactive element 32.

In the first preferred embodiment, impedance matching can be achieved by changing the reactance values of the reactive elements 31 and 32 so that a frequency interval between the two resonance frequencies $f_H$ and $f_L$ becomes optimum. In this case, it is acceptable to connect only the reactive element 31 or to connect only the reactive element 32. Furthermore, it is acceptable to connect both of the reactive element 31 and the reactive element 32. When both of the reactive element 31 and the reactive element 32 are electrically connected therein and controlled, there is such a unique advantageous effect that impedance matching can be achieved more easily than when either one of them is adopted.

Figure 3A:
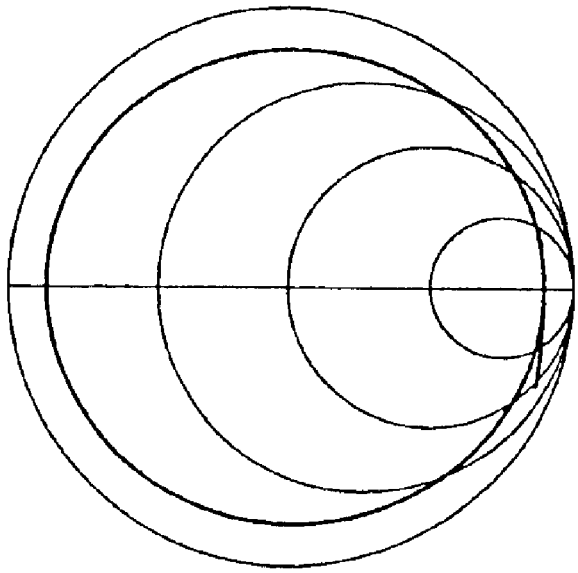
Fig.3A PRIOR ART
FIG. 3A is a Smith chart showing an impedance characteristic of a top-loading monopole antenna apparatus of the prior art of FIG. 39.
Figure 3B:
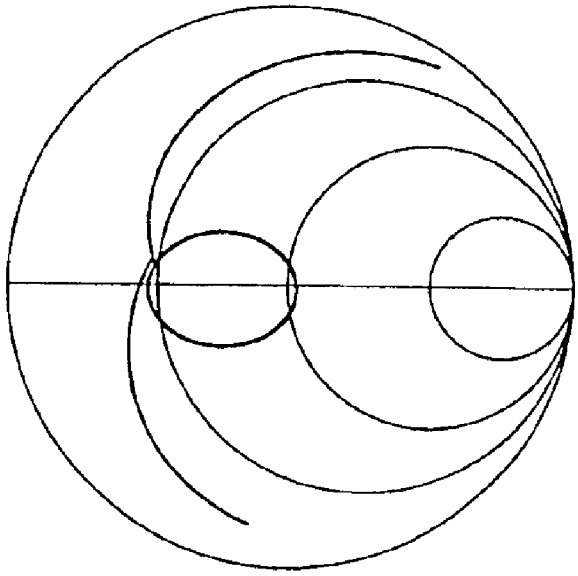
FIG. 3B is a Smith chart showing an impedance characteristic of the top-loading monopole antenna apparatus of the first preferred embodiment of FIG. 1A.

FIG. 3A is a Smith chart showing an impedance characteristic of the top-loading monopole antenna apparatus of the prior art of FIG. 39, and FIG. 3B is a Smith chart showing an impedance characteristic of the top-loading monopole antenna apparatus of the first preferred embodiment of FIG. 1A. Both of the Smith charts show the impedance characteristics which are obtained by a frequency sweep from 500 MHz to 1500 MHz. As is apparent from FIGS. 3A and 3B, it can be understood that the frequency difference between the two resonance frequencies becomes reduced in the first preferred embodiment rather than that in the prior art, in contrast to the prior art in which the frequency difference between the two resonance frequencies has a large separation.

The second problem of the prior art concerning the increase in size of the circular flat-plate-shaped electrode 11 can be solved by controlling the reactance values of the reactive element 31 and the reactive element 32 in a manner similar to that of the first problem. In order to solve the problem of the increase in size of the circular flat-plate-shaped electrode 11, it is required that the resonance frequencies $f_H$ and $f_L$ can be reduced without increasing the size of the circular flat-plate-shaped electrode 11. According to the first preferred embodiment, by employing an inductor of an inductive load as each of the reactive element 31 and the reactive element 32, both of the resonance frequencies $f_H$ and $f_L$ can be reduced without increasing the size of the electrode 11.

In the above-mentioned first preferred embodiment, each of the reactive elements 31 and 32 may be an inductor or a capacitor. Moreover, although the electrode 11 has a circular flat-plate-like shape, the present invention is not limited thereto. The electrode 11 may have another flat plate-like shape of a rectangle, a polygon, an ellipse or the like. In the case of the circular flat-plate-shaped electrode 11, the directivity characteristic of the antenna apparatus is allowed to be planar-symmetric with respect to a virtual formation plane which is formed of the linear conductor element 12 and the short-circuit conductor 13. Further, in the antenna apparatus of the first preferred embodiment, the short-circuit conductor 13 operates as a wave director, and a relative gain in the direction toward the short-circuit conductor 13 increases. However, by making the grounding conductor 14 have a circular shape, there is such a unique advantageous effect that constraint conditions in the direction in which the antenna apparatus is provided can be reduced. These modified preferred embodiments as well as the operation and advantageous effects thereof are similar to those of the first preferred embodiment in the preferred embodiments described hereinbelow.

Second Preferred Embodiment

Figure 4:
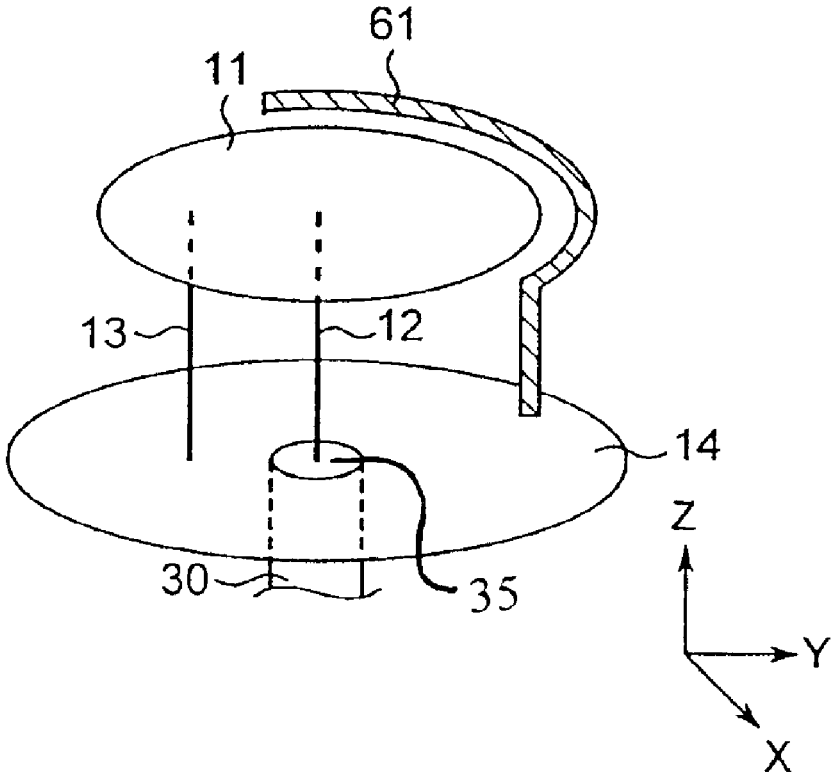
FIG. 4 is a perspective view showing a structure of a top-loading monopole antenna apparatus according to a second preferred embodiment of the present invention.

FIG. 4 is a perspective view showing a structure of a top-loading monopole antenna apparatus according to the second preferred embodiment of the present invention. The top-loading monopole antenna apparatus of the second preferred embodiment provides means for solving the above-mentioned third problem of the prior art concerning the band. As shown in FIG. 4, the second preferred embodiment is characterized in that a parasitic element 61 is provided at a predetermined distance from the electrode 11 without being in contact with the electrode 11 so as to extend along an outer edge portion of the circular flat-plate-shaped electrode 11 so that predetermined electromagnetic field coupling is caused, as compared with the prior art of FIG. 39. In this case, one end of the parasitic element 61 is electrically connected with the grounding conductor 14, and the parasitic element 61 then extends so as to be parallel to the linear conductor element 12. After the parasitic element 61 is bent partway in the length of the parasitic element 61, it is extended by a predetermined length around the circumference of the electrode 11 along the outer edge portion of the circular flat-plate-shaped electrode 11.

Figure 5:
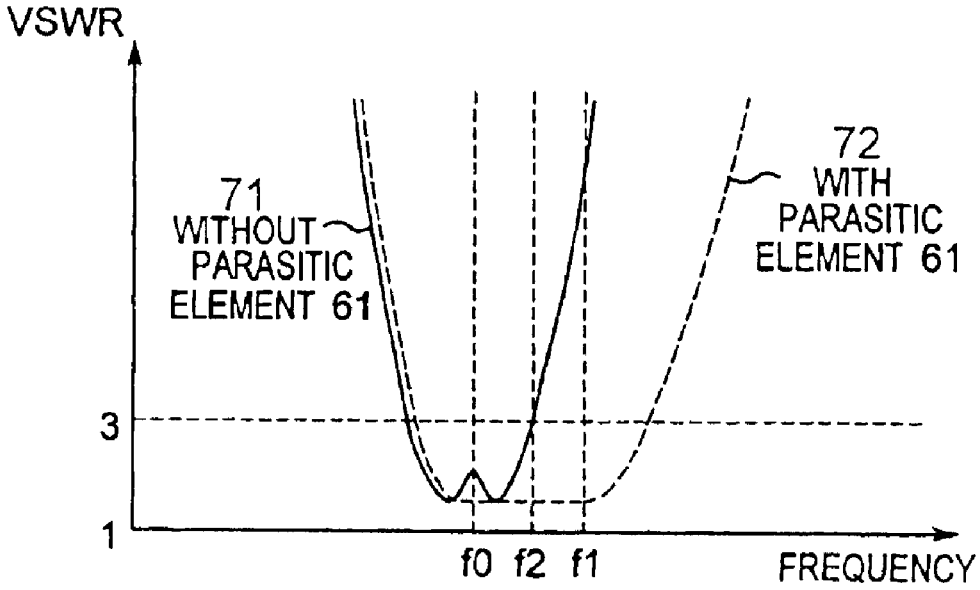
FIG. 5 is a graph showing a frequency characteristic of the VSWR of the top-loading monopole antenna apparatus of FIG. 4.

FIG. 5 is a graph showing a frequency characteristic of the VSWR of the top-loading monopole antenna apparatus of FIG. 4. In this case, the VSWR represents an index which represents a ratio of electric power that is reflected from the antenna apparatus out of the electric power that is fed to the antenna apparatus according to the degree of impedance matching, as well known. When impedance matching is completely achieved, i.e., in the center position of the Smith chart, then VSWR=1. In general, the frequency range, in which the VSWR is equal to or smaller than three, or the VSWR is equal to or smaller than two, is assumed to be the operating bandwidth of an antenna apparatus. A threshold value of the VSWR is determined according to the mobile communication system in which the antenna apparatus is employed. In this case, a frequency width in which the VSWR is equal to or smaller than three is assumed to be the operating bandwidth.

In FIG. 5, the characteristic 71 of the solid line shows the frequency characteristic of the VSWR in the absence of the parasitic element 61 (as in the prior art), and the characteristic 72 of the dashed line shows the frequency characteristic of the VSWR with the presence of the parasitic element 61 (as in the first preferred embodiment). In this case, the frequency width in which the VSWR is equal to or smaller than three is the operating bandwidth. The bandwidth of the prior art in the absence of the parasitic element 61 is only the frequency bandwidth in which the VSWR of the characteristic 71 is equal to or smaller than three. In this case, it is assumed that the center frequency of the characteristic 71 is f0, and the frequency at which the VSWR of the characteristic 71 is three is f2.

In this case, if the parasitic element 61 is added to the antenna apparatus of the prior art, then the parasitic element 61 also operates as an antenna element. The parasitic element 61 is fed with electric power by an induced current flowing in the parasitic element 61 due to a change of an electromagnetic field that is generated by excitation of the circular flat-plate-shaped electrode 11. Then, at the designing stage of an antenna element which is constituted by comprising only the parasitic element 61, the designing is carried out so that the frequency at which the VSWR is three becomes f2. Therefore, with the parasitic element 61 added, the operating bandwidth of the antenna apparatus becomes a wider bandwidth in which the VSWR falls below three as indicated by the characteristic 72, and this allows the antenna apparatus to have a widened frequency range.

Third Preferred Embodiment

Figure 6:
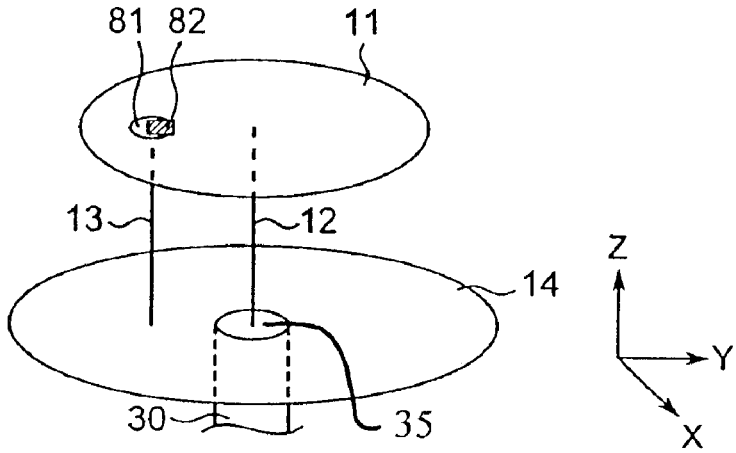
FIG. 6 is a perspective view showing a structure of a top-loading monopole antenna apparatus according to a third preferred embodiment of the present invention.

FIG. 6 is a perspective view showing a structure of a top-loading monopole antenna apparatus according to the third preferred embodiment of the present invention. The top-loading monopole antenna apparatus of the third preferred embodiment is characterized in being different from the top-loading monopole antenna apparatus of the prior art shown in FIG. 39 at least with respect to the following points. That is, a ring-shaped space 81 is formed at one end of the short-circuit conductor 13 on the side of the electrode 11 and its neighborhood portion, and the one end of the short-circuit conductor 13 is electrically connected with the electrode 11 through a reactive element 82. The other structure is similar to that of the prior art.

In the antenna apparatus constituted as described above, the resonance frequency is changed by changing the reactance value of the reactive element 82 provided between the circular flat-plate-shaped electrode 11 and the short-circuit conductor 13. By this operation, the impedance characteristic of FIG. 3A can be changed similar to, for example, the impedance characteristic of FIG. 3B in a manner similar to that of the first preferred embodiment, so that impedance matching between the characteristic impedance of the coaxial cable 30 for feeding electric power or transmitting a RF signal and the input impedance of the antenna apparatus can be achieved.

Figure 7:
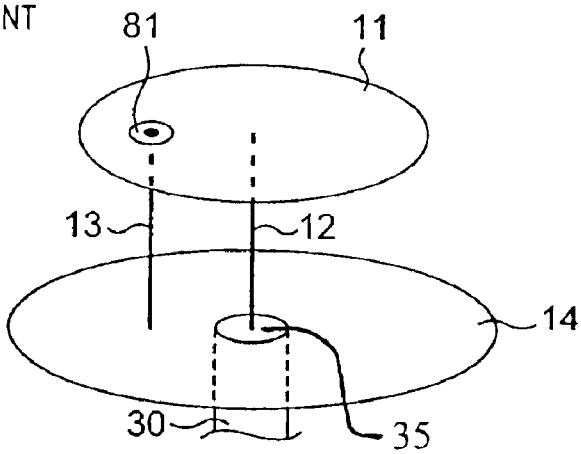
FIG. 7 is a perspective view showing a structure of a top-loading monopole antenna apparatus according to a first modified preferred embodiment of the third preferred embodiment of the present invention.

FIG. 7 is a perspective view showing a structure of a top-loading monopole antenna apparatus according to a first modified preferred embodiment of the third preferred embodiment of the present invention. The top-loading monopole antenna apparatus of the first modified preferred embodiment of the third preferred embodiment is characterized in that the reactive element 82 is removed, as compared with the third preferred embodiment of FIG. 6. In the ring-shaped space 81, one end of the short-circuit conductor 13 and the electrode 11 are located apart from each other by a predetermined constant distance (hereinafter referred to as an isolation distance of the ring-shaped space 81), and the ring-shaped space 81 operates as a capacitor by air between the one end of the short-circuit conductor 13 and the electrode 11. By changing the isolation distance of the ring-shaped space 81, the capacitance value of the capacitor of the ring-shaped space 81 substituting for the reactive element 82 can be changed, and the resonance frequency of the antenna apparatus can be changed.

Figure 8:
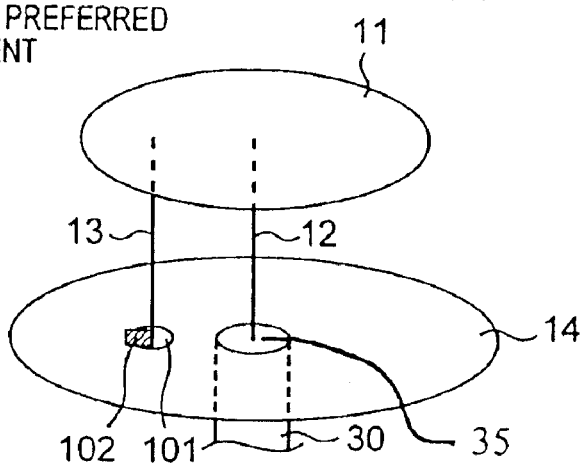
FIG. 8 is a perspective view showing a structure of a top-loading monopole antenna apparatus according to a second modified preferred embodiment of the third preferred embodiment of the present invention.

FIG. 8 is a perspective view showing a structure of a top-loading monopole antenna apparatus according to a second modified preferred embodiment of the third preferred embodiment of the present invention. The top-loading monopole antenna apparatus of the second modified preferred embodiment is characterized in being different from the top-loading monopole antenna apparatus of the prior art shown in FIG. 39 at least with respect to the following points. That is, a ring-shaped space 101 is formed at another end of the short-circuit conductor 13 on the side of the grounding conductor 14 and its neighborhood portion, and the another end of the short-circuit conductor 13 is electrically connected with the grounding conductor 14 through a reactive element 102. The other structure is similar to that of the prior art. Therefore, the ring-shaped space 101 and the reactive element 102 of the second modified preferred embodiment of the third preferred embodiment are the replacement of the ring-shaped space 81 and the reactive element 82 formed at the electrode 11 of the third preferred embodiment of FIG. 6, so as to be located in the grounding conductor 14 side. The series-resonant equivalent circuits of them are identical to each other, and the second modified preferred embodiment has an operation and advantageous effects which are similar to those of the third preferred embodiment.

In the second modified preferred embodiment of the third preferred embodiment, it is acceptable to provide only the ring-shaped space 101 without providing the reactive element 102 in a manner similar to that of the first modified preferred embodiment of the third preferred embodiment. In this case, one end of the short-circuit conductor 13 and the electrode 11 are located apart from each other by a predetermined constant distance (hereinafter referred to as an isolation distance of the ring-shaped space 101), and the ring-shaped space 101 operates as a capacitor by air between the one end of the short-circuit conductor 13 and the electrode 11. By changing the isolation distance of the ring-shaped space 101, the capacitance value of the capacitor of the ring-shaped space 81 substituting for the reactive element 102 can be changed, and the resonance frequency of the antenna apparatus can be changed.

Fourth Preferred Embodiment

Figure 9:
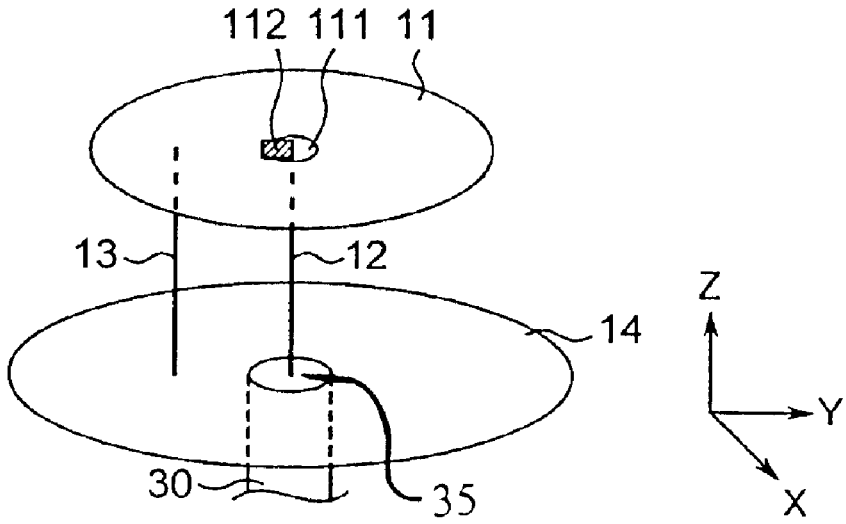
FIG. 9 is a perspective view showing a structure of a top-loading monopole antenna apparatus according to a fourth preferred embodiment of the present invention.

FIG. 9 is a perspective view showing a structure of a top-loading monopole antenna apparatus according to a fourth preferred embodiment of the present invention. The top-loading monopole antenna apparatus of the fourth preferred embodiment is characterized in being different from the top-loading monopole antenna apparatus of the prior art shown in FIG. 39 at least with respect to the following points. That is, a ring-shaped space 111 is formed at one end of the linear conductor element 12 on the side of the electrode 11 and its neighborhood portion, and the one end of the linear conductor element 12 is electrically connected with the electrode 11 through a reactive element 112. The other structure is similar to that of the prior art.

In the antenna apparatus constituted as describe above, the resonance frequency is changed by changing the reactance value of the reactive element 112 that is provided between the circular flat-plate-shaped electrode 11 and the linear conductor element 12. By this operation, the impedance characteristic of FIG. 3A can be changed similar to, for example, the impedance characteristic of FIG. 3B in a manner similar to that of the first and second preferred embodiments, so that impedance matching between the characteristic impedance of the coaxial cable 30 for feeding electric power or transmitting a RF signal and the input impedance of the antenna apparatus can be achieved.

In the fourth preferred embodiment, when the reactive element 112 is a capacitor, the resonance frequency of the circuit that includes the element can be increased. However, when the reactive element 112 is an inductor, the resonance frequency of circuit that includes the element can be reduced.

In the fourth preferred embodiment, when the reactive element 112 is constituted by comprising a capacitor, the resonance frequency and the input impedance of the antenna apparatus can be controlled as described above by changing the capacitance value of the reactive element 112. According to experiments conducted by the present inventors, when, for example, the diameter of the circular flat-plate-shaped electrode 11 is set to 50 mm, the length in the longitudinal direction of the linear conductor element 12 and the short-circuit conductor 13 is set to 10 mm and the capacitance value of the reactive element 111 is set to 1 pF, then the resonance frequency $f_L$ became about 800 MHz and the resonance frequency $f_H$ became about 1080 MHz.

Figure 10:
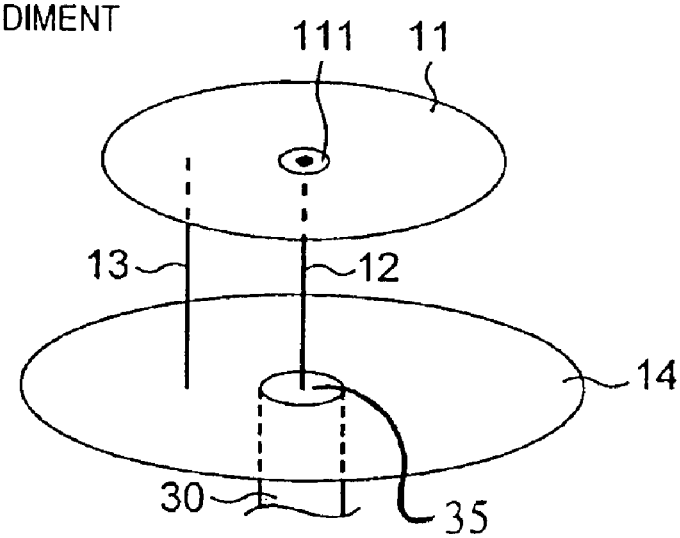
FIG. 10 is a perspective view showing a structure of a top-loading monopole antenna apparatus according to a modified preferred embodiment of the fourth preferred embodiment of the present invention.

FIG. 10 is a perspective view showing a structure of a top-loading monopole antenna apparatus according to a modified preferred embodiment of the fourth preferred embodiment of the present invention. The top-loading monopole antenna apparatus of the modified preferred embodiment of the fourth preferred embodiment is characterized in that the reactive element 112 is removed, as compared with the fourth preferred embodiment of FIG. 9. In the ring-shaped space 111, one end of the linear conductor element 12 and the electrode 11 are located apart from each other by a predetermined constant distance (hereinafter referred to as an isolation distance of the ring-shaped space 111), and the ring-shaped space 111 operates as a capacitor by air between the one end of the linear conductor element 12 and the electrode 11. By changing the isolation distance of the ring-shaped space 111, the capacitance value of the capacitor of the ring-shaped space 111 substituting for the reactive element 112 can be changed, and the resonance frequency of the antenna apparatus can be changed.

Fifth Preferred Embodiment

Figure 11:
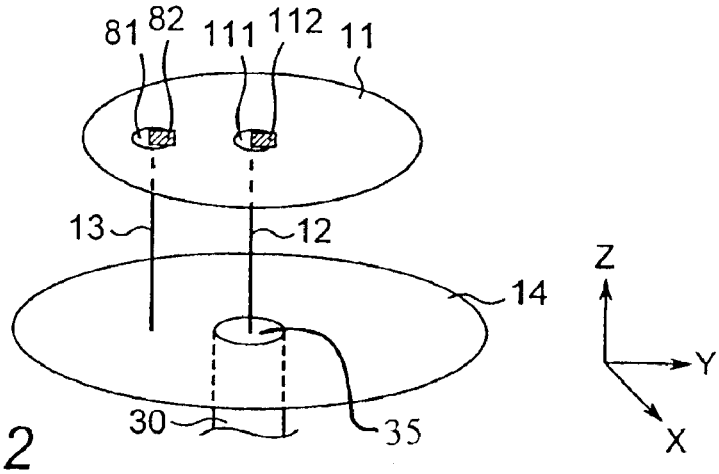
FIG. 11 is a perspective view showing a structure of a top-loading monopole antenna apparatus according to a fifth preferred embodiment of the present invention.

FIG. 11 is a perspective view showing a structure of a top-loading monopole antenna apparatus according to the fifth preferred embodiment of the present invention. The fifth preferred embodiment is a combination of the structure of the third preferred embodiment and the structure of the fourth preferred embodiment. The antenna apparatus of the fifth preferred embodiment has a structure substantially similar to the structure of the first preferred embodiment of FIG. 1A, and is characterized in that the circular hole formed in the first preferred embodiment is replaced by the ring-shaped space 111 or 81, a reactive element 112 is employed in place of the reactive element 31, and a reactive element 82 is employed in place of the reactive element 32.

In the fifth preferred embodiment, when the reactive element 82 is constituted by comprising a capacitor and the reactive element 112 is constituted by comprising an inductor, the resonance frequency and the input impedance of the antenna apparatus can be controlled as described above by changing the reactance values of the reactive elements 82 and 112. Therefore, impedance matching can be achieved more accurately at a lower frequency in such a state that the length of the linear conductor element 12 is shortened and the diameter of the circular flat-plate-shaped electrode 11 is reduced.

Figure 12:
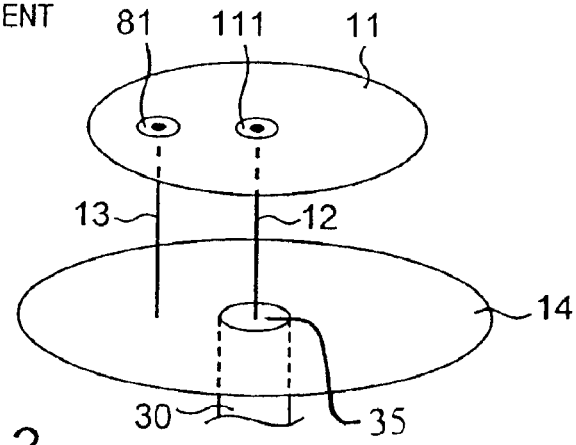
FIG. 12 is a perspective view showing a structure of a top-loading monopole antenna apparatus according to a first modified preferred embodiment of the fifth preferred embodiment of the present invention.

FIG. 12 is a perspective view showing a structure of a top-loading monopole antenna apparatus according to a first modified preferred embodiment of the fifth preferred embodiment of the present invention. The first modified preferred embodiment of the fifth preferred embodiment is obtained by removing the reactive elements 82 and 112 from the structure of the fifth preferred embodiment in a manner similar to those of the structures of the first modified preferred embodiment of the third preferred embodiment of FIG. 7 and the modified preferred embodiment of the fourth preferred embodiment of FIG. 10. The first modified preferred embodiment of the fifth preferred embodiment thus has an operation and advantageous effects which are similar to those of these modified preferred embodiments.

Figure 13:
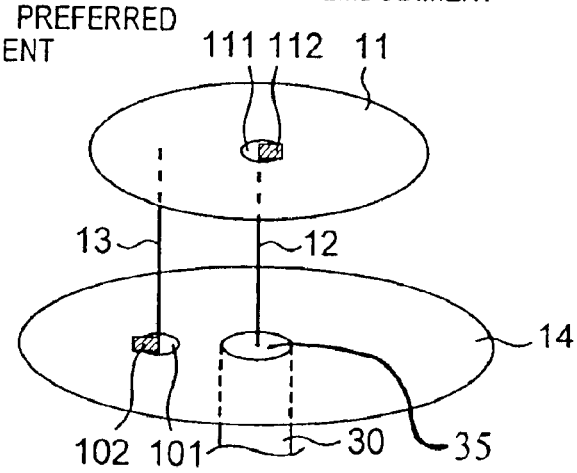
FIG. 13 is a perspective view showing a structure of a top-loading monopole antenna apparatus according to a second modified preferred embodiment of the fifth preferred embodiment of the present invention.

FIG. 13 is a perspective view showing a structure of a top-loading monopole antenna apparatus according to a second modified preferred embodiment of the fifth preferred embodiment of the present invention. In the second modified preferred embodiment of the fifth preferred embodiment, the ring-shaped space 81 and the reactive element 82 formed at the electrode 11 in the structure of the fifth preferred embodiment are formed at the grounding conductor 14, making these elements 81 and 82 serve as the ring-shaped space 101 and the reactive element 102, in a manner similar to that of the second modified preferred embodiment of the third preferred embodiment of FIG. 8. That is, the ring-shaped space 101 is formed at another end of the short-circuit conductor 13 on the side of the grounding conductor 14 and its neighborhood portion, and the another end of the short-circuit conductor 13 is electrically connected with the grounding conductor 14 through the reactive element 102. The second modified preferred embodiment of the fifth preferred embodiment thus has an operation and advantageous effects which are similar to those of the second modified preferred embodiment of the third preferred embodiment of FIG. 8.

Sixth Preferred Embodiment

Figure 14:
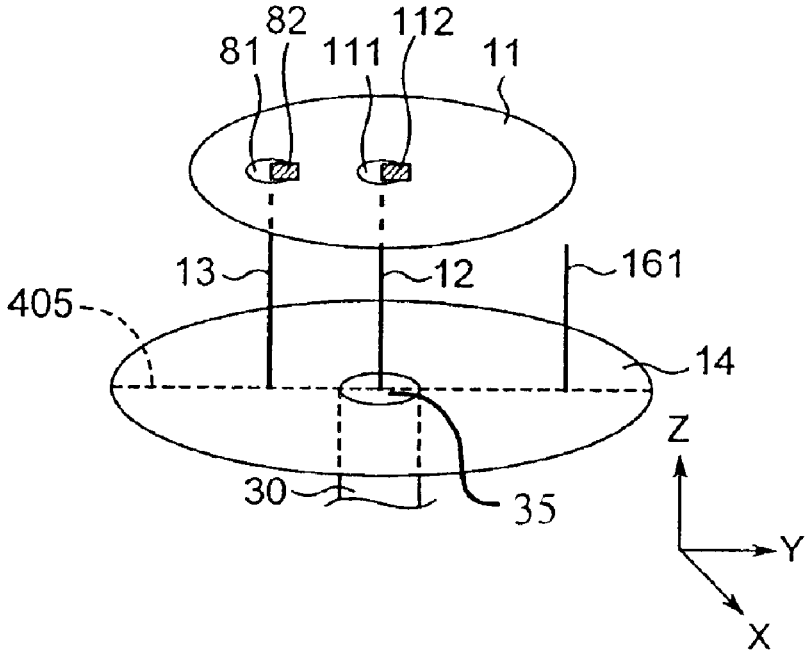
FIG. 14 is a perspective view showing a structure of a top-loading monopole antenna apparatus according to a sixth preferred embodiment of the present invention.

FIG. 14 is a perspective view showing a structure of a top-loading monopole antenna apparatus according to the sixth preferred embodiment of the present invention. The sixth preferred embodiment is characterized in that a parasitic element 161 having a length that is shorter than the length of the linear conductor element 12 and the short-circuit conductor 13 is further provided upright on the grounding conductor 14 so as to be parallel to the linear conductor element 12 and the short-circuit conductor 13 at a position on the grounding conductor 14, which passes on a virtual straight line 405 (as indicated by a dotted line in FIG. 14, and hereinafter referred to as a straight line 405) extending from a straight line that connects the connecting location of the linear conductor element 12 with the connecting location of the short-circuit conductor 13 on the grounding conductor 104, as compared with the structure of the fifth preferred embodiment.

By providing the parasitic element 161 so as to be substantially parallel to the linear conductor element 12 and the short-circuit conductor 13, an electric field which is caused by an induced current flowing in the parasitic element 161 due to a change of an electromagnetic field that is generated by the excitation of the linear conductor element 12 and the short-circuit conductor 13 is generated in the parasitic element 161, and thus the input impedance of the antenna apparatus can be controlled. In this case, by changing a distance from the linear conductor element 12 to the parasitic element 161 and the length of the parasitic element 161, the input impedance of the antenna apparatus can be controlled. Therefore, according to the sixth preferred embodiment, there are obtained such unique operation and advantageous effects that the input impedance of the antenna apparatus can be controlled more simply.

Figure 15:
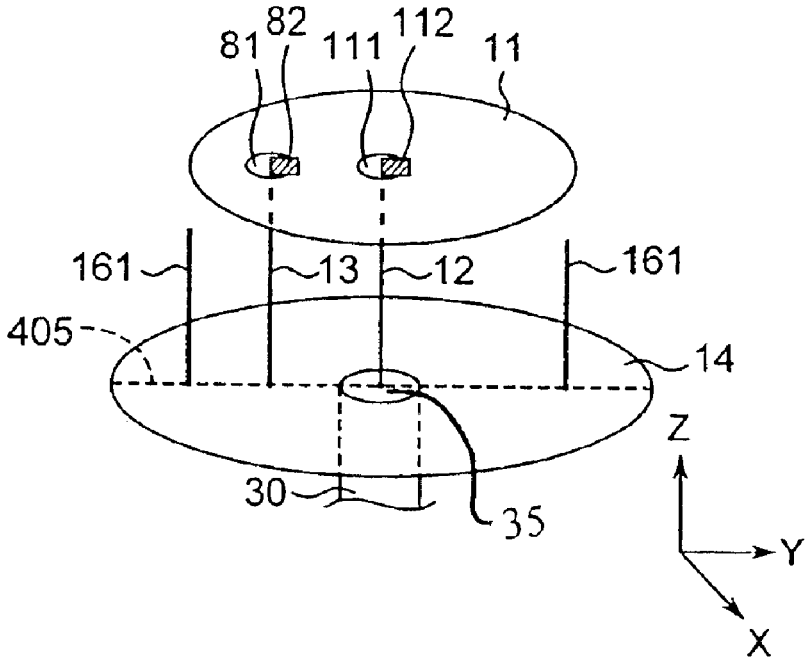
FIG. 15 is a perspective view showing a structure of a top-loading monopole antenna apparatus according to a modified preferred embodiment of the sixth preferred embodiment of the present invention.

FIG. 15 is a perspective view showing a structure of a top-loading monopole antenna apparatus according to a modified preferred embodiment of the sixth preferred embodiment of the present invention. The modified preferred embodiment of the sixth preferred embodiment is characterized in that two parasitic elements 161 are provided upright symmetrically with respect to the linear conductor element 12 on the straight line 405 of the grounding conductor 14, as compared with the sixth preferred embodiment. According to the modified preferred embodiment of the sixth preferred embodiment, there are obtained such unique operation and advantageous effects that the radiation directivity characteristic of the antenna apparatus can be made to be close to the omni-directional characteristic by arranging a plurality of parasitic elements 161 symmetrically with respect to the linear conductor element 12.

Seventh Preferred Embodiment

Figure 16:
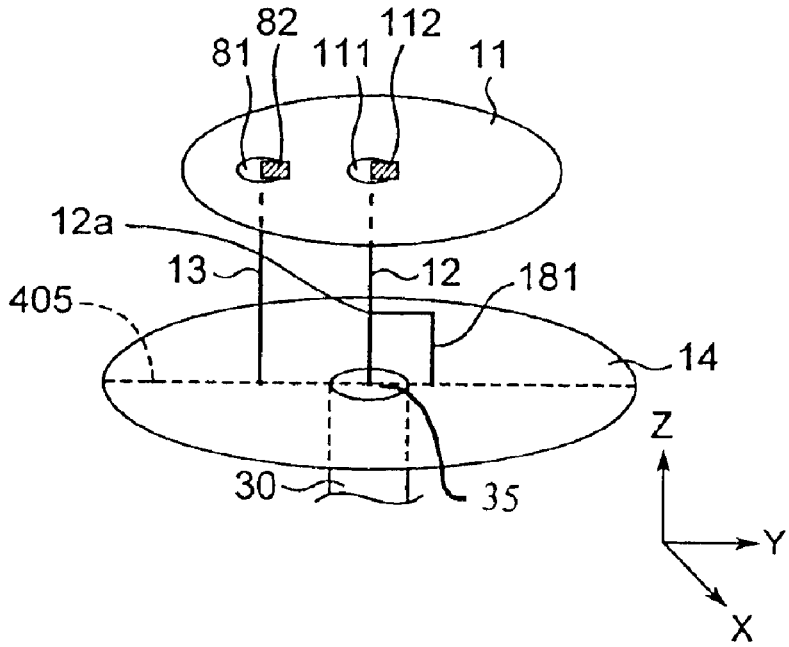
FIG. 16 is a perspective view showing a structure of a top-loading monopole antenna apparatus according to a seventh preferred embodiment of the present invention.

FIG. 16 is a perspective view showing a structure of a top-loading monopole antenna apparatus according to the seventh preferred embodiment of the present invention. The seventh preferred embodiment is characterized in that another short-circuit control conductor 181 is further provided, as compared with the fifth preferred embodiment of FIG. 11. In this case, one end of the another short-circuit control conductor 181 is electrically connected with the linear conductor element 12 at a connection point 12*a* in an intermediate position in the longitudinal direction of the linear conductor element 12, and another end of the short-circuit control conductor 181 is electrically connected with the grounding conductor 14 at a position where the conductor passes through the straight line 405 on the grounding conductor 14.

In the seventh preferred embodiment, by shifting the connection point 12*a* of the short-circuit control conductor 181 on the linear conductor element 12, the input impedance of the antenna apparatus can be controlled more finely, and the loss due to the impedance mismatching can be reduced.

Figure 17:
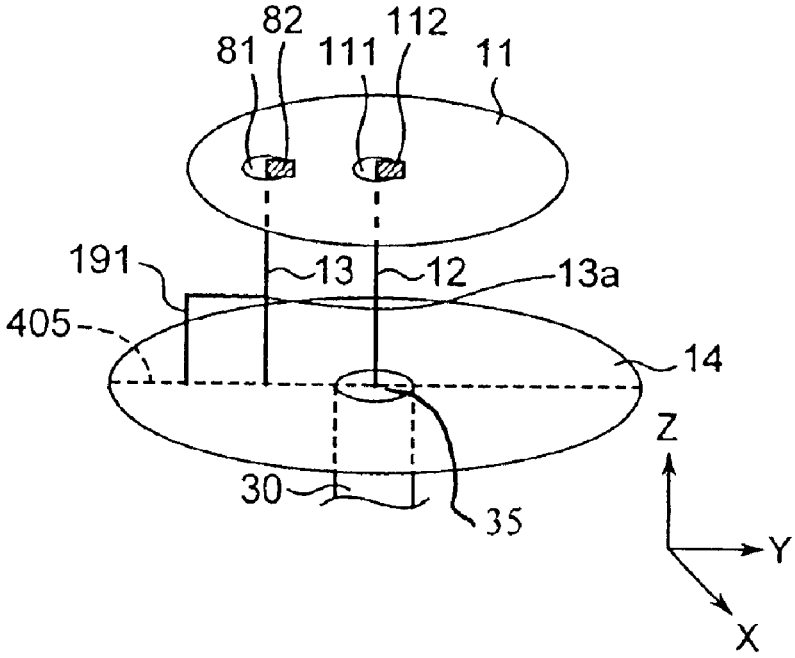
FIG. 17 is a perspective view showing a structure of a top-loading monopole antenna apparatus according to a modified preferred embodiment of the seventh preferred embodiment of the present invention.

FIG. 17 is a perspective view showing a structure of a top-loading monopole antenna apparatus according to a modified preferred embodiment of the seventh preferred embodiment of the present invention. The modified preferred embodiment of the seventh preferred embodiment is characterized in that another short-circuit control conductor 191 is further provided, as compared with the fifth preferred embodiment of FIG. 11. In this case, one end of the another short-circuit control conductor 191 is electrically connected with the short-circuit conductor 13 at a connection point 13*a* in an intermediate position in the longitudinal direction of the short-circuit conductor 13, and another end of the short-circuit control conductor 191 is electrically connected with the grounding conductor 14 at a position where the conductor passes through the straight line 405 on the grounding conductor 14.

In the modified preferred embodiment of the seventh preferred embodiment, by shifting the connection point 13*a* of the short-circuit control conductor 191 on the short-circuit conductor 13, the resonance frequency $f_L$ of the first antenna element of the antenna apparatus can be changed. In this case, the connection point 13*a* of the short-circuit control conductor 191 and the short-circuit conductor 13 can be continuously changed, and therefore, the resonance frequency $f_L$ can be changed more finely.

Eighth Preferred Embodiment

Figure 18:
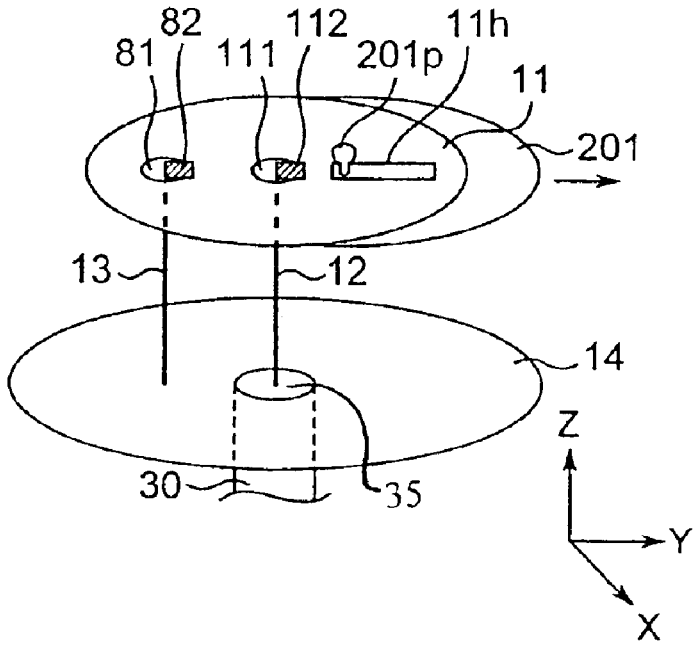
FIG. 18 is a perspective view showing a structure of a top-loading monopole antenna apparatus according to an eighth preferred embodiment of the present invention.

FIG. 18 is a perspective view showing a structure of a top-loading monopole antenna apparatus according to the eighth preferred embodiment of the present invention. The eighth preferred embodiment is characterized in that there is further provided another circular flat-plate-shaped movable electrode 201, which is electrically connected with the circular flat-plate-shaped electrode 11 by being in contact with the rear surface of the electrode 11 and which is able to change the contact area thereof, as compared with the structure of the fifth preferred embodiment. In this case, there is formed a strip-shaped rectangular hole 11*h* that extends from the center thereof or its neighborhood portion to the outer edge portion of the electrode 11 thereof or its neighborhood portion, and a sliding knob 201*p* having one end fixed into the movable electrode 201 is provided so as to protrude vertically from the top surface of the electrode 11 through the rectangular hole 11*h*.

The sliding knob 201*p* operates so as to make the movable electrode 201 be in close contact with the electrode 11, and by sliding the movable electrode 201 in a direction of the arrow with the sliding knob 20 1*p* moved in the longitudinal direction of the rectangular hole 11*h*, the area of the movable electrode 201 protruding from the outer edge portion of the electrode 11 can be increased. By this operation, the effective total area, which contributes to the radiation of the electrode 11 and the movable electrode 201 constituting the top-loading section of the antenna apparatus, can be increased, and then, the capacitance value of the top-loading section can be increased. That is, the total effective size of the circular flat-plate-shaped electrodes 11 and 201 is changed, and therefore, the resonance frequency $f_H$ of the first antenna element of the antenna apparatus can be changed. According to the eighth preferred embodiment, the resonance frequency of the antenna apparatus can be mechanically changed, and the operating bandwidth of the antenna apparatus can be increased.

In the eighth preferred embodiment, the movable electrode 201 is provided for the fifth preferred embodiment. However, the present invention is not limited thereto, and it is acceptable to provide the movable electrode 201 for the structure of any of the other preferred embodiments of the present invention.

Ninth Preferred Embodiment

Figure 19:
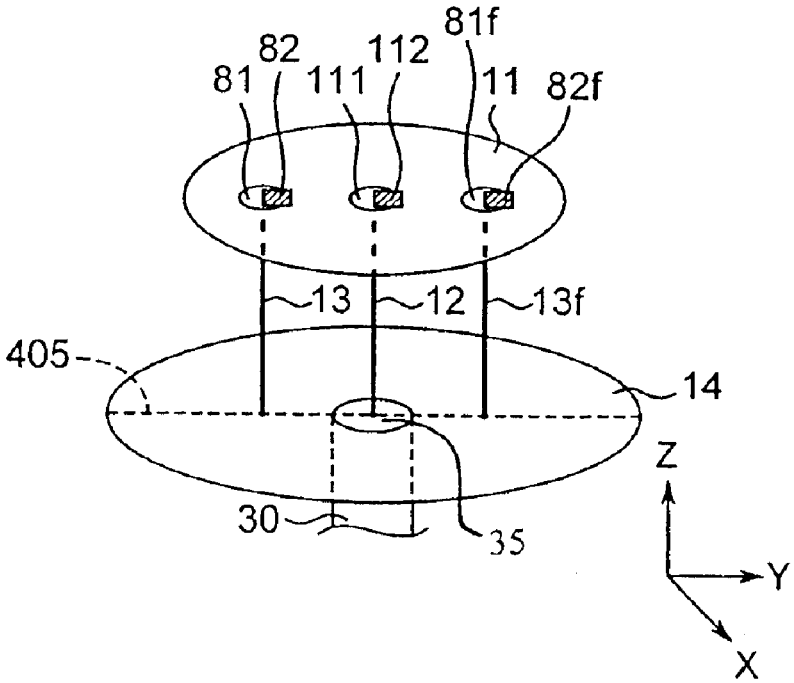
FIG. 19 is a perspective view showing a structure of a top-loading monopole antenna apparatus according to a ninth preferred embodiment of the present invention.

FIG. 19 is a perspective view showing a structure of a top-loading monopole antenna apparatus according to the ninth preferred embodiment of the present invention. The ninth preferred embodiment is characterized in that another short-circuit conductor 13*f* is further provided at a position which is symmetrical to the short-circuit conductor 13 with interposition of the linear conductor element 12, as compared with the structure of the fifth preferred embodiment of FIG. 11. In this case, one end of the short-circuit conductor 13*f* is located in the center of a ring-shaped space 8 if that is formed in the electrode 11 and is electrically connected with the electrode 11 through a reactive element 82*f*. Moreover, another end of the short-circuit conductor 13*f* is electrically connected with a position which is located on the grounding conductor 14 and through which the straight line 405 passes.

By further providing the short-circuit conductor 13*f* with which the reactive element 82*f* is electrically connected as in the ninth preferred embodiment, another antenna element can be formed by forming another series resonance circuit, and then, the resonance frequency of the antenna apparatus can be increased. With this arrangement, an antenna apparatus having a number of resonance frequencies can be provided.

Tenth Preferred Embodiment

Figure 20:
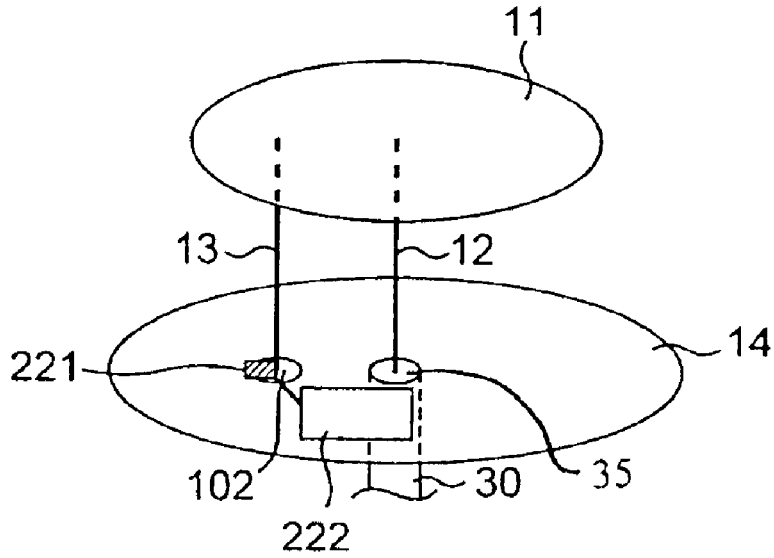
FIG. 20 is a perspective view showing a structure of a top-loading monopole antenna apparatus according to a tenth preferred embodiment of the present invention.

FIG. 20 is a perspective view showing a structure of a top-loading monopole antenna apparatus according to the tenth preferred embodiment of the present invention. The tenth preferred embodiment is characterized in being different from the second modified preferred embodiment of the third preferred embodiment of FIG. 8 at least with respect to the following points.

(1) A variable capacitance diode 221 is provided in place of the reactive element 102.

(2) A voltage control circuit 222 for generating and applying a bias voltage to the variable capacitance diode 221 is formed by a circuit pattern which is formed on the grounding conductor 14 through a dielectric substrate (not shown).

In the tenth preferred embodiment constituted as described above, by changing the bias voltage that is applied from the voltage control circuit 222 to the variable capacitance diode 221, the capacitance value (i.e., reactance value) of the variable capacitance diode can be changed. This allows the resonance frequency $f_L$ of the second antenna element of the antenna apparatus to be changed and allows the operating bandwidth to be widened.

The tenth preferred embodiment described above is provided with the variable capacitance diode 221 in place of the reactive element 102 of the second modified preferred embodiment of the third preferred embodiment of FIG. 8. However, the present invention is not limited thereto, and each of the reactive elements 82 and 112 may be constituted by comprising a variable capacitance diode.

Figure 21:
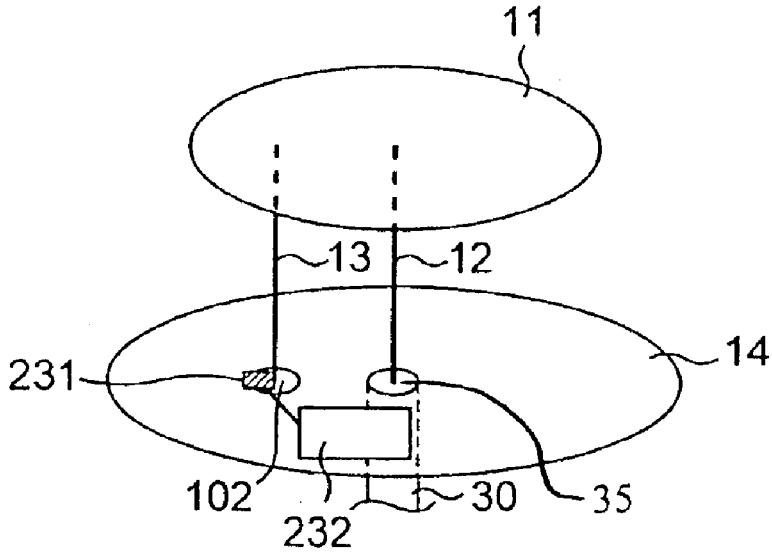
FIG. 21 is a perspective view showing a structure of a top-loading monopole antenna apparatus according to a modified preferred embodiment of the tenth preferred embodiment of the present invention.

FIG. 21 is a perspective view showing a structure of a top-loading monopole antenna apparatus according to a modified preferred embodiment of the tenth preferred embodiment of the present invention. The modified preferred embodiment of the tenth preferred embodiment is characterized in being different from the second modified preferred embodiment of the third preferred embodiment of FIG. 8 at least with respect to the following points.

(1) A switching diode 231 is provided in place of the reactive element 102.

(2) A voltage control circuit 232 for generating and applying a switching control voltage to the switching diode 231 is formed by a circuit pattern which is formed on the grounding conductor 14 through a dielectric substrate (not shown).

In the modified preferred embodiment of the tenth preferred embodiment constituted as described above, the switching diode 231 can be turned on or off by changing the switching control voltage that is applied from the voltage control circuit 232 to the switching diode 231, and this allows the resonance frequency $f_L$ of the second antenna element of the antenna apparatus to be changed. Moreover, the voltage control circuit 232 can be constituted more simply by employing the switching diode 231.

The modified preferred embodiment of the tenth preferred embodiment described above is provided with the switching diode 231 in place of the reactive element 102 of the second modified preferred embodiment of the third preferred embodiment of FIG. 8. However, the present invention is not limited thereto, and each of the reactive elements 82 and 112 may be constituted by comprising a switching diode.

Eleventh Preferred Embodiment

Figure 22:
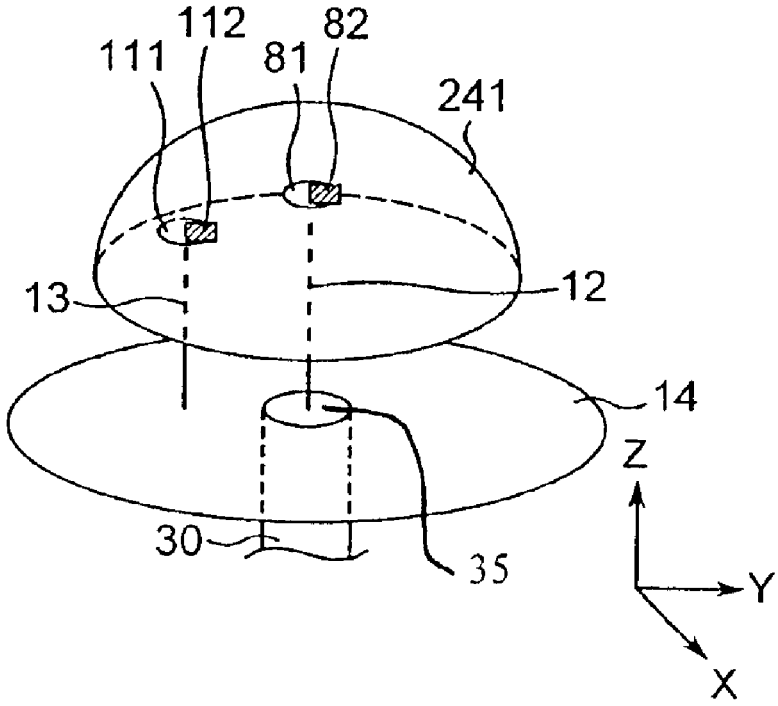
FIG. 22 is a perspective view showing a structure of a top-loading monopole antenna apparatus according to an eleventh preferred embodiment of the present invention.

FIG. 22 is a perspective view showing a structure of a top-loading monopole antenna apparatus according to the eleventh preferred embodiment of the present invention. The eleventh preferred embodiment is characterized in that a hollow hemispherical electrode 241 (having a semicircular cross-section shape, including a curved shape) is provided in place of the circular flat-plate-shaped electrode 11, as compared with the fifth preferred embodiment of FIG. 11.

As described above, in the fifth preferred embodiment, the resonance frequency of the top-loading monopole antenna apparatus is determined by the length of the linear conductor element 12 and the diameter of the circular flat-plate-shaped electrode 11. The resonance frequency is changed particularly by a length from one end of the linear conductor element 12 to the edge portion of the circular flat-plate-shaped electrode 11 on the circular flat-plate-shaped electrode 11, and then, the resonance frequency can be reduced by increasing the above-mentioned length.

In the eleventh preferred embodiment, by employing the hemispherical electrode 241, a projected area of the electrode 241 of the top-loading section on the grounding conductor 14 can be reduced further than when the electrode 11 is employed, and this allows the antenna apparatus to be reduced in size and weight, as compared with the fifth preferred embodiment.

Figure 23:
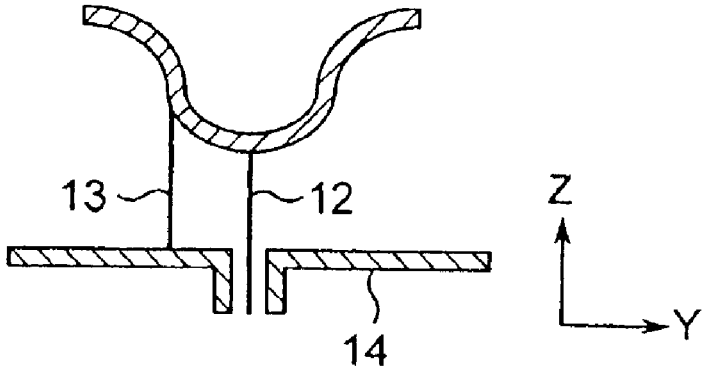
FIG. 23 is a longitudinal sectional view showing a structure of a top-loading monopole antenna apparatus according to a modified preferred embodiment of the eleventh preferred embodiment of the present invention.

FIG. 23 is a longitudinal sectional view showing a structure of a top-loading monopole antenna apparatus according to a modified preferred embodiment of the eleventh preferred embodiment of the present invention. The modified preferred embodiment of the eleventh preferred embodiment is characterized in that an electrode 251 having a shape, which has a hollow hemispherical lower portion (having a semicircular cross-section shape, including a curved shape) swelled downward and curved in the cross-section from the outer edge portion of the hemisphere of the lower portion and extends so that the outer diameter of the electrode 251 is larger than that of its lower portion is provided in place of the hollow hemispherical electrode 241, as compared with the eleventh preferred embodiment of FIG. 22. In the modified preferred embodiment of the eleventh preferred embodiment, a distance from one end of the linear conductor element 12 to the edge portion of the electrode 251 can be made longer, as compared with the projected area of the electrode 251 on the grounding conductor 14. That is, the resonance frequency can be reduced by increasing the distance.

Twelfth Preferred Embodiment

Figure 24:
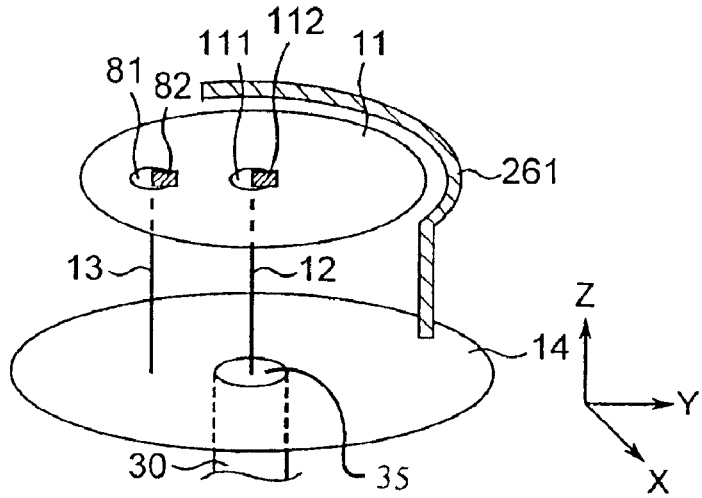
FIG. 24 is a perspective view showing a structure of a top-loading monopole antenna apparatus according to a twelfth preferred embodiment of the present invention.

FIG. 24 is a perspective view showing a structure of a top-loading monopole antenna apparatus according to the twelfth preferred embodiment of the present invention. The twelfth preferred embodiment is a combination of the structure of the second preferred embodiment of FIG. 4 and the structure of the fifth preferred embodiment of and FIG. 11, and is characterized in being different from the prior art of FIG. 39 at least with respect to the following points.

(1) A ring-shaped space 111 and a reactive element 112 are provided at one end of the linear conductor element 12.

(2) A ring-shaped space 81 and a reactive element 82 are provided at one end of the short-circuit conductor 13.

(3) A parasitic element 261 is provided at a predetermined distance from the electrode 11 without being in contact with the electrode so as to extend along the outer edge portion of the circular flat-plate-shaped electrode 11 so that predetermined electromagnetic field coupling is caused.

In this case, one end of the parasitic element 261 is electrically connected with the grounding conductor 14, and the parasitic element 261 is then extended so as to be parallel to the linear conductor element 12. After the parasitic element 261 is bent partway in the length of the parasitic element 261, the parasitic element 261 is extended by a predetermined length around the circumference of the electrode 11 along the outer edge portion of the circular flat-plate-shaped electrode 11.

That is, the twelfth preferred embodiment is provided with the parasitic element 261 having one end short-circuited with the grounding conductor 14. Therefore, the parasitic element 261 functions as an antenna element due to an induced current flowing in the parasitic element 261 due to a change of an electromagnetic field which is generated by the excitation of the circular flat-plate-shaped electrode 11 as described above. It is preferable to set the resonance frequency of the parasitic element 261 to the frequency f1 of FIG. 5. Further, it is referable to set the length of the portion extending along the circular flat-plate-shaped electrode 11 to ¼ wavelength at this time. With the above-mentioned structure, a current distribution on the parasitic element 261 becomes zero at the end of the portion that is not short-circuited and becomes maximized at a bent portion 261*a*. This is 5 because, when the length of the parasitic element 261 extending along the electrode 11 is ¼ wavelength, the length becomes the length of resonance at the resonance frequency of the antenna apparatus. Then, in the parasitic element 261, the intensity of the current flowing in the bent portion 261*a* becomes the maximum, and therefore, the maximum 10 gain of the antenna element becomes the maximum.

Figure 25:
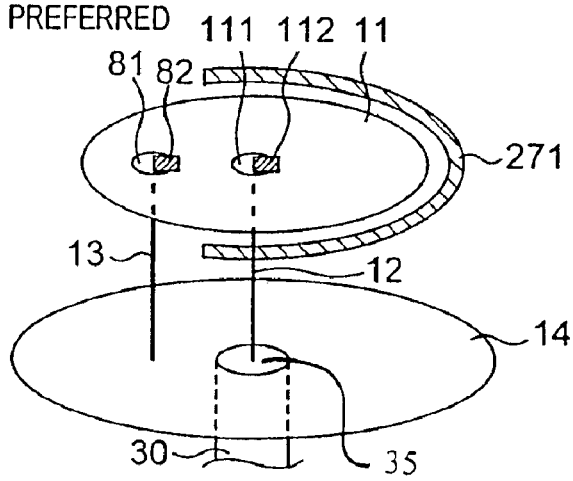
FIG. 25 is a perspective view showing a structure of a top-loading monopole antenna apparatus according to a first modified preferred embodiment of the twelfth preferred embodiment of the present invention.

FIG. 25 is a perspective view showing a structure of a top-loading monopole antenna apparatus according to a first modified preferred embodiment of the twelfth preferred embodiment of the present invention. The first modified preferred embodiment of the twelfth preferred embodiment is characterized in that a parasitic element 271 having a length of ½ wavelength and having both ends not short-circuited is provided in place of the parasitic element 261 having one end short-circuited, as compared with the twelfth preferred embodiment. In this case, the parasitic element 271 is supported by a predetermined support member (not shown) which is made of an electrically insulating material so as to extend along the outer edge portion of the electrode 11. The parasitic element 271 functions as an antenna element with an induced current flowing in the parasitic element 271 due to a change of an electromagnetic field which is generated by the excitation of the circular flat-plate-shaped electrode 11. In a manner similar to that of the parasitic element 261, the resonance frequency of the parasitic element 271 is designed so as to be the frequency f1 of FIG. 5. It is preferable to set the length of the parasitic element 271 to ½ wavelength. The reason for this is that the current at both ends of the parasitic element 271 becomes zero since both ends of the parasitic element 271 are opened, and the parasitic element 271 having a longitudinal length of ½ wavelength operates as a resonant element so that the current flowing in the center of the parasitic element 271 becomes maximized.

The first modified preferred embodiment of the twelfth preferred embodiment is provided with one parasitic element 271. However, the present invention is not limited thereto, and it is acceptable to provide a plurality of parasitic elements 271 along the outer edge portion of the electrode 11.

Figure 26:
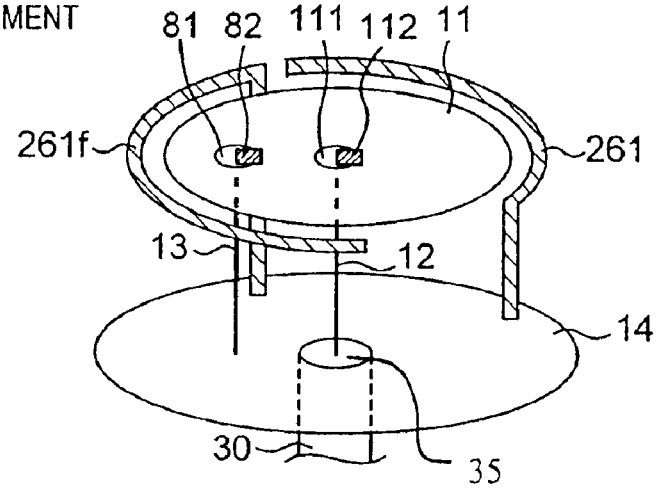
FIG. 26 is a perspective view showing a structure of a top-loading monopole antenna apparatus according to a second modified preferred embodiment of the twelfth preferred embodiment of the present invention.

FIG. 26 is a perspective view showing a structure of a top-loading monopole antenna apparatus according to a second modified preferred embodiment of the twelfth preferred embodiment of the present invention. The second modified preferred embodiment of the twelfth preferred embodiment is characterized in that there is further provided a parasitic element 261*f*, which is in addition to the parasitic element 261 and which has a structure similar to that of the parasitic element 261, as compared with the twelfth preferred embodiment of FIG. 24. As described above, by providing the plurality of parasitic elements 261 and 261*f*, the radiation directivity characteristic of the antenna apparatus can be made to be close to the omni-directional characteristic.

Thirteenth Preferred Embodiment

Figure 27:
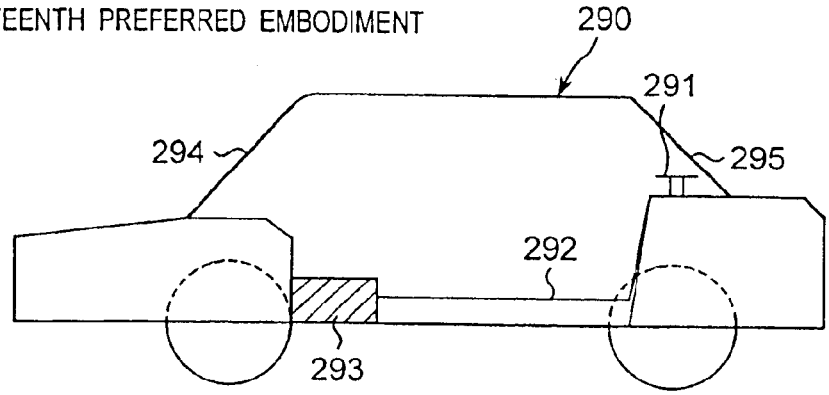
FIG. 27 is a perspective view showing a structure of a mobile communication system according to a thirteenth preferred embodiment of the present invention.

FIG. 27 is a perspective view showing a structure of a mobile communication system according to the thirteenth preferred embodiment of the present invention. The thirteenth preferred embodiment relates to a method for installing, in a vehicle 290, a top-loading monopole antenna apparatus 291, which is described in connection with the first through twelfth preferred embodiments and the modified preferred embodiments thereof and which is provided with the linear conductor element 12 and the short-circuit conductor 13, and also provides a mobile communication system including the antenna apparatus 291.

Referring to FIG. 27, the antenna apparatus 291 is provided on an internal housing of the vehicle 290 near a rear window 295 of the vehicle 290. In this case, a radio communication apparatus 293 is provided in the vehicle 290, and the radio communication apparatus 293 is electrically connected with the antenna apparatus 291 by way of a coaxial cable 292 for feeding electric power. In this case, the short-circuit conductor 13 of the antenna apparatus 291 is placed so as to be located closer to the rear window 295 than the linear conductor element 12.

In the antenna apparatus 291 of the preferred embodiments of the present invention, the size of the circular flat-plate-shaped electrode 11 can be reduced, as compared with the top-loading monopole antenna apparatus of the prior art, and therefore, the required size of the grounding conductor 14 can also be reduced. With this arrangement, the antenna apparatus 291 is suitable for installing the same antenna apparatus 291 in the vehicle 290. By placing the antenna apparatus 291 in the vehicle 290, the coaxial cable 292 for feeding electric power can also be shortened. This makes it possible to restrain the probability of mixture of vehicle noises due to the coaxial cable 292 for feeding electric power and to restrain the deterioration of a high-frequency signal and a control signal.

Furthermore, the antenna apparatus 291 of the preferred embodiments of the present invention has the short-circuit conductor 13, and therefore, the antenna apparatus 291 has the maximum gain in a direction toward the short-circuit conductor 13 when viewed from the linear conductor element 12. By directing this direction having the maximum gain toward the side of the rear window 295 where there are few obstacles such as the metal edges of the window when viewed from the antenna apparatus 291, a radiation beam of the radio wave can be directed toward the rear of the vehicle 290.

Furthermore, the antenna apparatus 291 of the preferred embodiments of the present invention may be provided on the internal housing of the vehicle 290 near a front window 294. In this case, the antenna apparatus 291 is provided so that the short-circuit conductor 13 is positioned on the side of the front window 294 when viewed from the linear conductor element 12. With this arrangement, the radiation beam of the radio wave can be directed in the forward direction of the vehicle 290.

Figure 28:
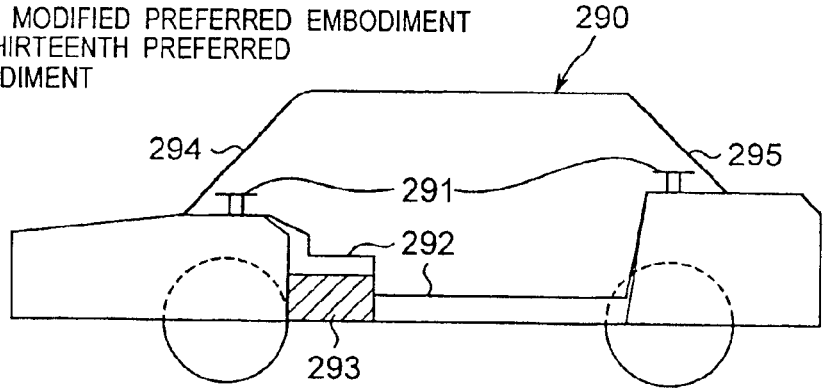
FIG. 28 is a perspective view showing a structure of a mobile communication system according to a first modified preferred embodiment of the thirteenth preferred embodiment of the present invention.

FIG. 28 is a perspective view showing a structure of a mobile communication system according to a first modified preferred embodiment of the thirteenth preferred embodiment of the present invention. The first modified preferred embodiment of the thirteenth preferred embodiment relates to a method for installing two antenna apparatuses 291 in the vehicle 290, and is characterized in that a first antenna apparatus 291 is provided on the internal housing of a vehicle 290 in the vicinity of the front window 294 and a second antenna apparatus 291 is provided on the internal housing of the vehicle 290 in the vicinity of the rear window 295.

Referring to FIG. 28, a radiation beam of the radio wave is formed in the forward direction of the vehicle 290 by providing the first antenna apparatus 291 with its short-circuit conductor 13 located on the side of the front window 294 when viewed from the linear conductor element 12, while a radiation beam of the radio wave is formed in the rearward direction of the vehicle 290 by providing the second antenna apparatus 291 having its short-circuit conductor 13 located on the side of the rear window 295 when viewed from the linear conductor element 12. Since there are the two radiation beams in the forward and rearward directions of the vehicle 290, a directivity characteristic which is made to be closer to the omni-directional characteristic than that of one radiation beam can be obtained.

In the first modified preferred embodiment of the thirteenth preferred embodiment, the two antenna apparatuses 291 are provided apart from each other by a predetermined distance, and therefore, a space diversity effect can be obtained by a difference in the distance between the antenna apparatuses 291. Therefore, a further stabilized received signal can be obtained by selecting one received signal having a greater received signal strength from among the two signals that are received by the two antenna apparatuses 291 or by subjecting the two received signals to the maximum ratio combining manner or the other manner similar thereto. By this operation, further stabilized reception radio communications can be achieved.

Figure 29:
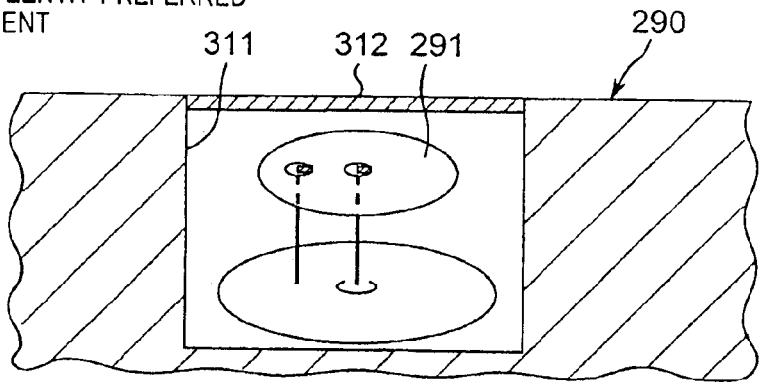
FIG. 29 is a perspective view showing a structure of a top-loading monopole antenna apparatus in a mobile communication system according to a second modified preferred embodiment of the thirteenth preferred embodiment of the present invention.

FIG. 29 is a perspective view showing a structure of a top-loading monopole antenna apparatus in a mobile communication system according to a second modified preferred embodiment of the thirteenth preferred embodiment of the present invention. The second modified preferred embodiment of the thirteenth preferred embodiment relates to a method for inconspicuously providing the top-loading monopole antenna apparatus 291 of the above-mentioned preferred embodiment on the inside of the vehicle 290, and the top-loading monopole apparatus 291 may be on the outside of the vehicle 290.

Referring to FIG. 29, the antenna apparatus 291 of the above-mentioned preferred embodiment is placed on the inside of a rectangular parallelepiped recess portion 311 which is formed on an internal housing 310 of the vehicle 290, and a radome 312 which is made of a predetermined dielectric material is provided on the opening of the recess portion 311 so as to cover the antenna apparatus 291 along the top surface of the internal housing 310.

Figure 30:
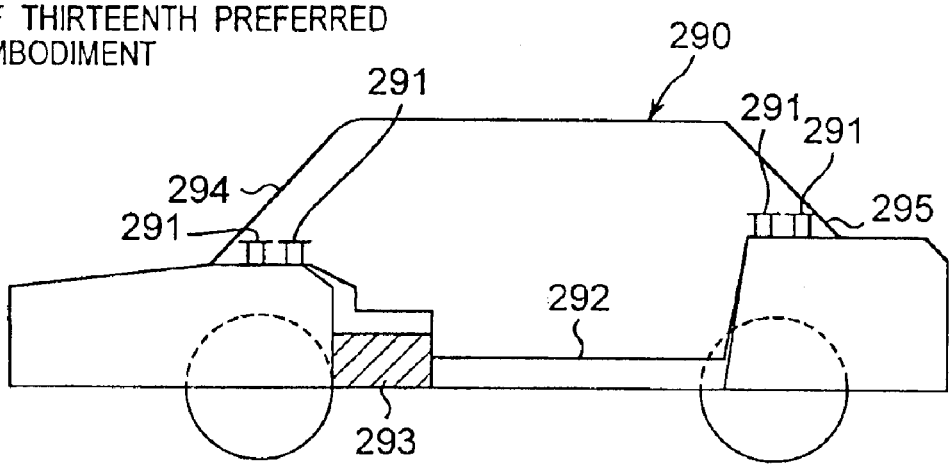
FIG. 30 is a perspective view showing a structure of a mobile communication system according to a third modified preferred embodiment of the thirteenth preferred embodiment of the present invention.

FIG. 30 is a perspective view showing a structure of a mobile communication system according to a third modified preferred embodiment of the thirteenth preferred embodiment of the present invention. The third modified preferred embodiment of the thirteenth preferred embodiment relates to a method for installing four antenna apparatuses 291 on the inside of the vehicle 290 and is characterized in that two first antenna apparatuses 291 are provided on the internal housing of the vehicle 290 in the vicinity of the front window 294, and two second antenna apparatuses 291 are provided on the internal housing of the vehicle 290 in the vicinity of the rear window 295.

Referring to FIG. 30, a radiation beam of the radio wave is formed in the forward direction of the vehicle 290 by providing the first antenna apparatuses 291 with their short-circuit conductors 13 being located on the side of the front window 294 when viewed from the linear conductor element 12, while a radiation beam of the radio wave is formed in the rearward direction of the vehicle 290 by providing the second antenna apparatuses 291 with their short-circuit conductors 13 being located on the side of the rear window 295 when viewed from the linear conductor element 12. Since there are two radiation beams in the forward and rearward directions of the vehicle 290, a directivity characteristic which is made to be closer to the omni-directional characteristic than when there is one radiation beam can be obtained.

According to the above-mentioned thirteenth preferred embodiment and the modified preferred embodiments thereof, they are possessed of the following unique advantageous effects.

(1) As shown in the modified preferred embodiment of FIG. 28, the radiation beam can be directed in both of the directions not depending on the direction of movement of the vehicle 290.

(2) As shown in the modified preferred embodiment of FIG. 29, the monopole antenna apparatus capable of being inconspicuously provided can be provided.

(3) As shown in FIGS. 27, 28 and 30, a low-profile monopole antenna apparatus suitable for installing the same in the vehicle 290 can be provided.

The radio communication apparatus 293 shown in FIGS. 27, 28 and 30 may be provided with at least one of a radio receiver (this may be otherwise a radio receiver circuit) and a radio transmitter (this may be otherwise a radio transmitter circuit).

Figure 51:
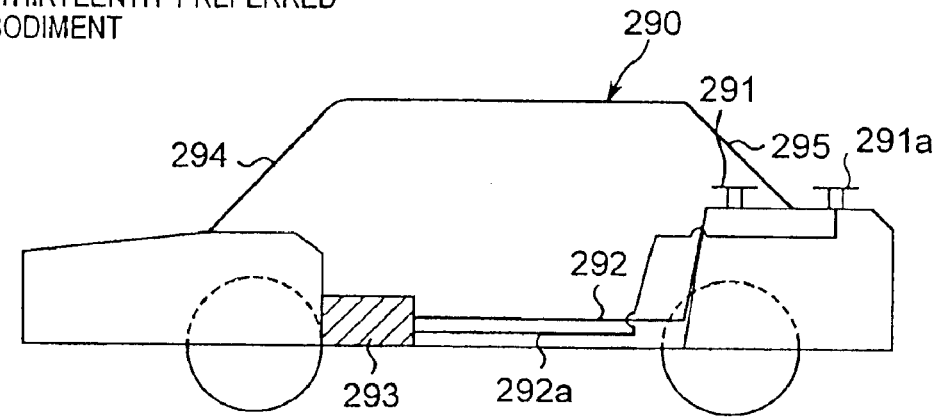
FIG. 51 is a perspective view showing a structure of a mobile communication system according to a fourth modified preferred embodiment of the thirteenth preferred embodiment of the present invention.

FIG. 51 is a perspective view showing a structure of a mobile communication system according to a fourth modified preferred embodiment of the thirteenth preferred embodiment of the present invention. In the mobile communication system of the fourth modified preferred embodiment of the thirteenth preferred embodiment, a top-loading monopole antenna apparatus 291*a* is provided on the outside of the vehicle 290 in addition to the top-loading monopole antenna apparatus 291 which is provided on the inside of the vehicle 290, and the top-loading monopole antenna apparatus 291*a* is electrically connected with the radio communication apparatus 293 through a coaxial cable 292*a* for feeding electric power or transmitting a RF signal, as compared with the mobile communication system of FIG. 27. As shown in FIG. 27, the top-loading monopole antenna apparatuses 291 and 291*a* are provided on the inside and outside of the vehicle 290. However, the present invention is not limited thereto, and the antenna apparatuses may be provided on at least one of the inside and the outside of the vehicle 290.

Figure 52:
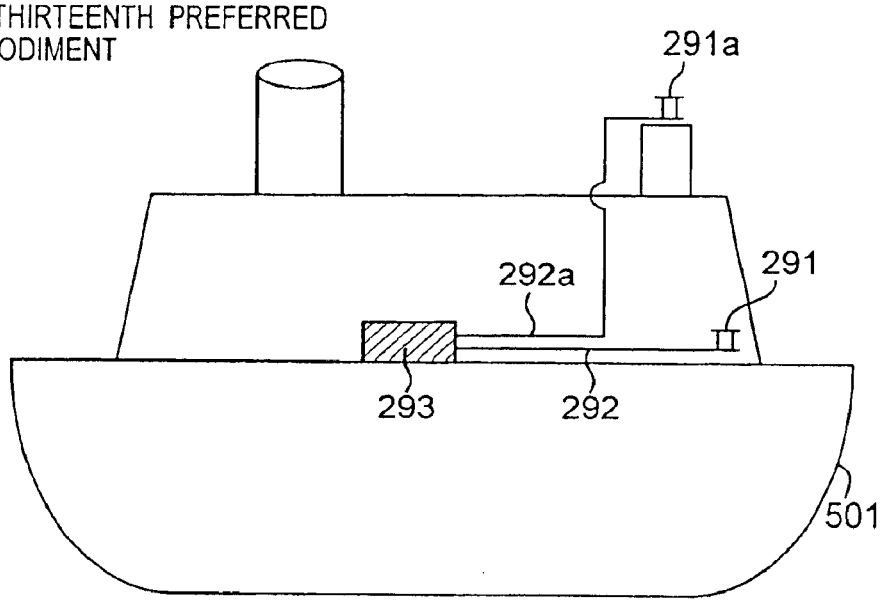
FIG. 52 is a perspective view showing a structure of a mobile communication system according to a fifth modified preferred embodiment of the thirteenth preferred embodiment of the present invention.
Figure 53:
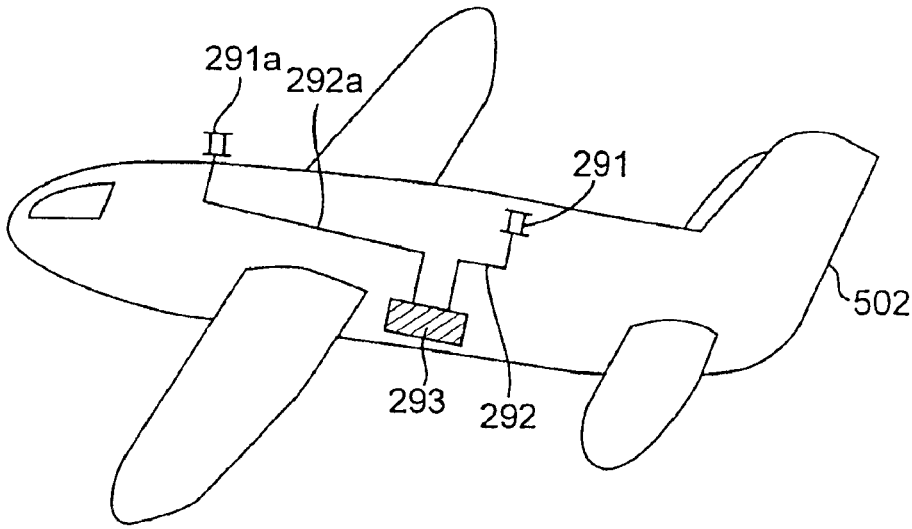
FIG. 53 is a perspective view showing a structure of a mobile communication system according to a sixth modified preferred embodiment of the thirteenth preferred embodiment of the present invention.

In the above-mentioned preferred embodiments and modified preferred embodiments, there is installed, in the vehicle 290, the top-loading monopole antenna apparatuses 291 and 291*a*, the radio communication apparatus 293 and the mobile communication system including them. However, the present invention is not limited thereto, and they may be installed on at least one of the inside and the outside of a ship 501 as shown in FIG. 52 showing a fifth modified preferred embodiment of the thirteenth preferred embodiment. Further, they may be installed on at least one of the inside and the outside of an airplane 502 as shown in FIG. 53 showing a sixth modified preferred embodiment of the thirteenth preferred embodiment. Furthermore, it is acceptable to install the top-loading monopole antenna apparatuses 291 and 291*a*, the radio communication apparatus 293 and the mobile communication system including them, in various kinds of mobile bodies other than vehicles, ships, boats, and airplanes. Furthermore, it is acceptable to install the top-loading monopole antenna apparatuses 291 and 291*a*, the radio communication apparatus 293 and a "communication system" including them, in fixed buildings or the like other than the mobile bodies.

Fourteenth Preferred Embodiment

Figure 45A:
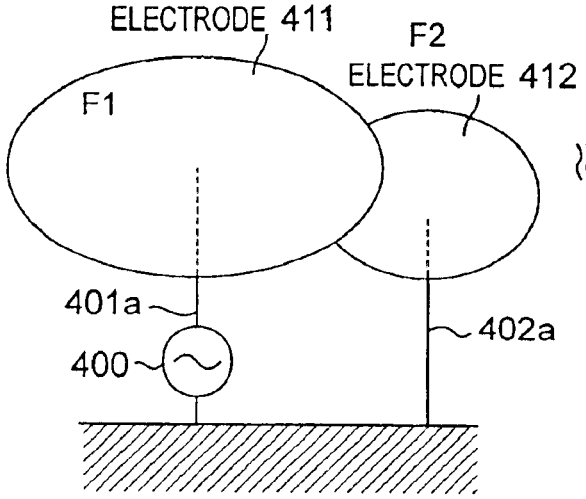
FIG. 45A is a schematic view of a top-loading monopole antenna apparatus according to a fourteenth preferred embodiment of the present invention.
Figure 45B:
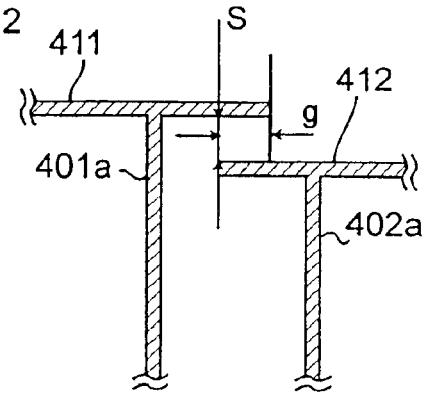
FIG. 45B is a longitudinal sectional view of a mutually adjacent position between two electrodes 411 and 412 of the top-loading monopole antenna apparatus of FIG. 45A.

FIG. 45A is a schematic view of a top-loading monopole antenna apparatus according to the fourteenth preferred embodiment of the present invention, and FIG. 45B is a longitudinal sectional view showing a mutually adjacent position between two electrodes 411 and 412 of the top-loading monopole antenna apparatus of FIG. 45A. The top-loading monopole antenna apparatus of the fourteenth preferred embodiment has a structure similar to that of FIGS. 42A and 42B described above. As shown in FIG. 45A, by making an electrode 412 of a passive (non-RF-feeding) top-loading element be close to the neighborhood of an electrode 411 of an excited (RF-feeding) top-loading element so that these elements 411 and 412 are electromagnetically coupled to each other; an antenna apparatus having two resonance frequencies F1 and F2 can be constituted.

Referring to FIG. 45A, by adding the electrode 411 to a tip of a radiator element 401*a* of a linear feeding element which is excited by a signal source 400 of a radio transmitter so that the electrode 411 opposes the grounding conductor surface and by adding the electrode 412 to a tip of a wave director element 402*a* of a parasitic (passive) linear conductor element so that the electrode 412 opposes the grounding conductor surface, these electrodes 411 and 412 serve as top-loading elements. The tip of the radiator element 401*a* is electrically connected with an approximately center portion of the circular electrode 411, and the tip of the wave director element 402*a* is electrically connected with an approximate center portion of the circular electrode 413. Moreover, the end portion of the radiator element 401*a* on the side of the signal source 400 of a radio transmitter becomes a feeding point. In this case, the two electrodes 411 and 412 are located spatially apart from each other; however, they are located close to each other so as to be electromagnetically coupled to each other. As shown in FIG. 45B, by changing the interval "S" in the vertical direction between the two electrodes 411 and 412 and the length "g" of the overlap portion in the horizontal direction of the electrodes 411 and 412, the electromagnetic coupling between the radiator element 401*a* and the wave director element 402*a* can be adjusted.

The antenna apparatus of the fourteenth preferred embodiment utilizes grounding to the earth. However, the present invention is not limited thereto, and the grounding conductor 14 having a finite size may be provided in place of the grounding to the earth as shown in, for example, FIG. 1.

Figure 46:
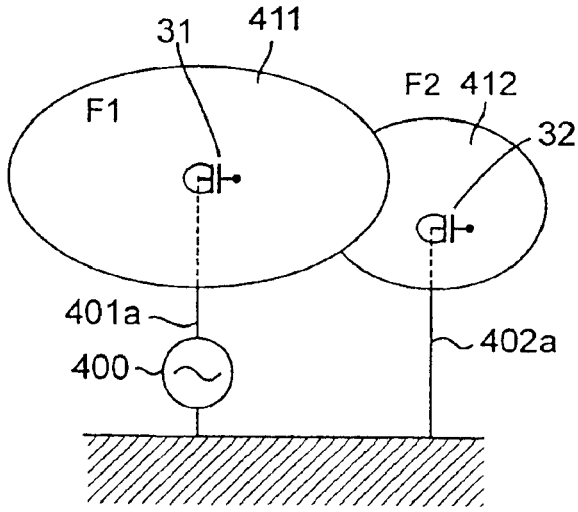
FIG. 46 is a schematic view of a top-loading monopole antenna apparatus according to a first modified preferred embodiment of the fourteenth preferred embodiment of the present invention.

FIG. 46 is a schematic view of a top-loading monopole antenna apparatus according to a first modified preferred embodiment of the fourteenth preferred embodiment of the present invention. The top-loading monopole antenna apparatus of the first modified preferred embodiment of the fourteenth preferred embodiment is characterized in that the reactive element 31 is inserted at the connection point between the tip of the radiator element 401*a* and the electrode 411, and the reactive element 32 is inserted at the connection point between the tip of the wave director element 402*a* and the electrode 412, as compared with the top-loading monopole antenna apparatus of FIGS. 45A and 45B. With the above-described arrangement, the antenna apparatus of FIG. 46 is allowed to have a size that is smaller than that of the antenna apparatus of FIG. 45A by virtue of a shortening effect of the reactive elements 31 and 32.

In the first modified preferred embodiment of the fourteenth preferred embodiment of FIG. 46, the reactive elements 31 and 32 are electrically connected with both of the electrodes 411 and 412, respectively. However, the present invention is not limited thereto, and the reactive elements 31 and 32 may be electrically connected with at least one of the electrodes 411 and 412.

Figure 47:
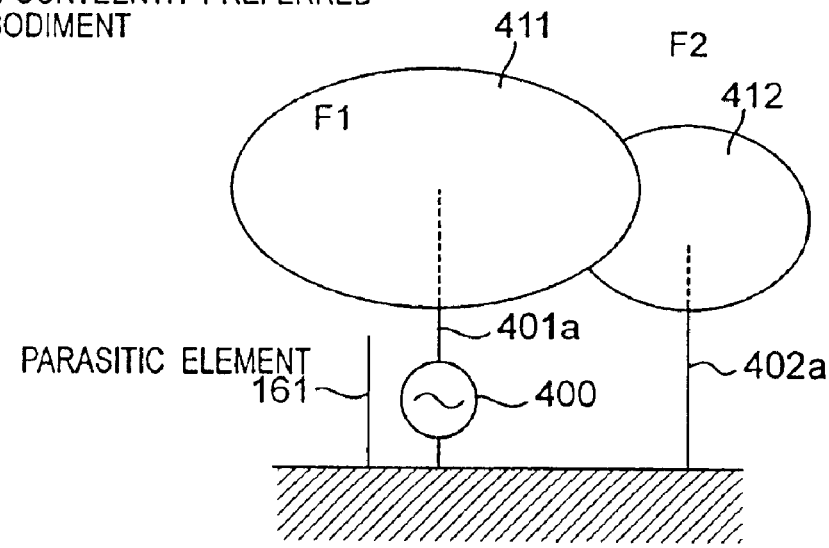
FIG. 47 is a schematic view of a top-loading monopole antenna apparatus according to a second modified preferred embodiment of the fourteenth preferred embodiment of the present invention.

FIG. 47 is a schematic view of a top-loading monopole antenna apparatus according to a second modified preferred embodiment of the fourteenth preferred embodiment of the present invention. The top-loading monopole antenna apparatus of the second modified preferred embodiment of the fourteenth preferred embodiment is characterized in that a linear parasitic element 161, having a length that is shorter than that of the radiator element 401*a*, having the tip or one end opened and having another end grounded, is provided on the opposite side of the wave director element 402*a*, so that the longitudinal direction thereof becomes substantially parallel to the radiator element 401*a*, as compared with the top-loading monopole antenna apparatus of FIGS. 45A and 45B. With the above-described arrangement, the input impedance at the feeding point of the radiator element 401*a* can be changed, and impedance matching at the feeding point can easily be performed.

Figure 48:
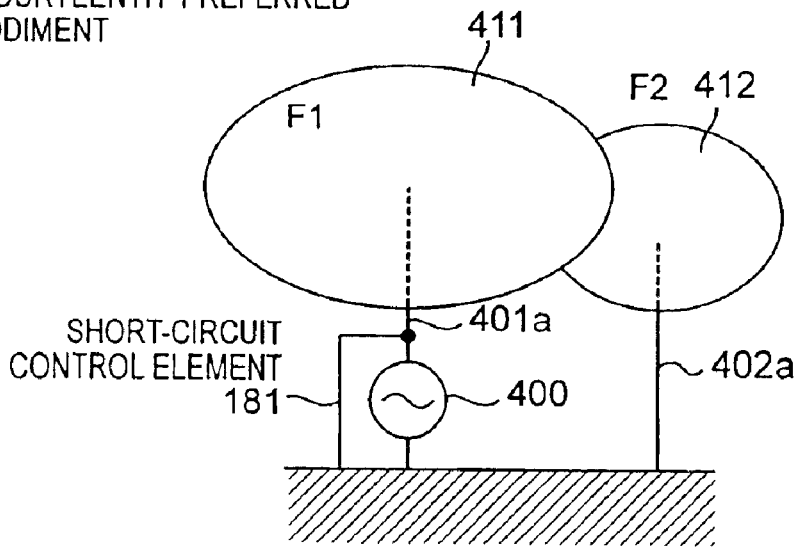
FIG. 48 is a schematic view of a top-loading monopole antenna apparatus according to a third modified preferred embodiment of the fourteenth preferred embodiment of the present invention.

FIG. 48 is a schematic view of a top-loading monopole antenna apparatus according to a third modified preferred embodiment of the fourteenth preferred embodiment of the present invention. The top-loading monopole antenna apparatus of the third modified preferred embodiment of the fourteenth preferred embodiment is characterized in that a short-circuit control element 181, having a tip or one end which is electrically connected with a predetermined intermediate position of the radiator element 401*a* and having another end grounded, is provided on the opposite side of the wave director element 402*a*, as compared with the top-loading monopole antenna apparatus of FIGS. 45A and 45B. The longitudinal direction of the short-circuit control element 181 (excluding the bent portion electrically connected with the radiator element 401*a*) is set so as to be substantially parallel to the longitudinal direction of the radiator element 401*a*. With the above-described arrangement, the short-circuit control element 181 operates as, for example, a reflector, and is capable of controlling the directivity characteristic of the antenna apparatus. The number of the short-circuit control elements 181 is not limited to one, and further, there may be a plurality of short-circuit control elements 181. As shown in FIG. 48, the parasitic element 161 of FIG. 47 may be further provided.

Figure 49:
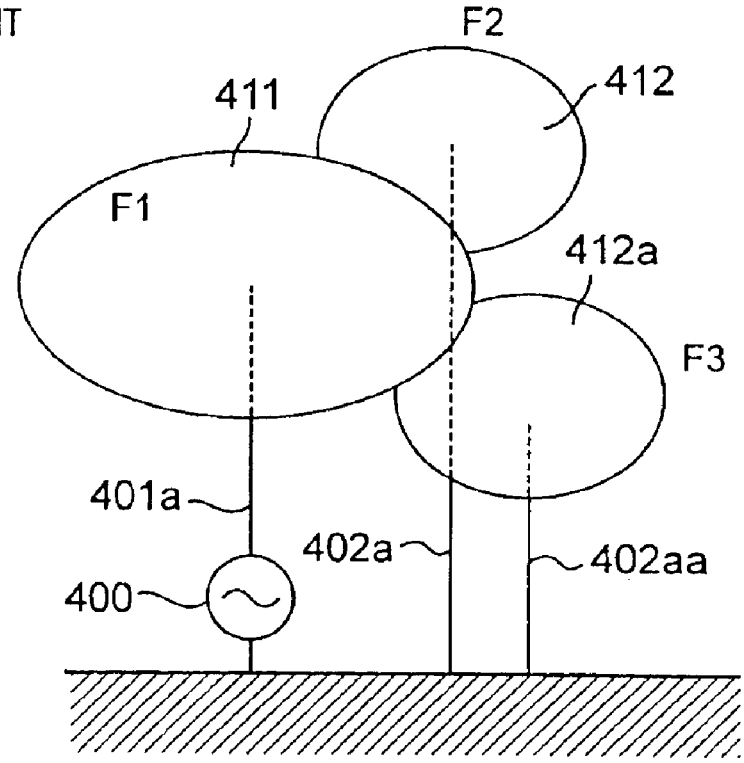
FIG. 49 is a schematic view of a top-loading monopole antenna apparatus according to a fourth modified preferred embodiment of the fourteenth preferred embodiment of the present invention.

FIG. 49 is a schematic view of a top-loading monopole antenna apparatus according to a fourth modified preferred embodiment of the fourteenth preferred embodiment of the present invention. The top-loading monopole antenna apparatus of the fourth modified preferred embodiment of the fourteenth preferred embodiment is characterized in that a wave director element 402*aa*, having a resonance frequency F3 (F3≠F2, and F3≠F1), having one end provided with a circular electrode 412*a* and having another end grounded, is further provided at a position which is located on the side of the wave director element 402*a* when viewed from the radiator element 401*a*, as compared with the top-loading monopole antenna apparatus of FIGS. 45A and 45B. In this case, the electrode 411 is not only located close to the electrode 412 so as to be electromagnetically coupled with the electrode 412, but is also located close to the electrode 412*a* so as to be electromagnetically coupled with the electrode 412*a*. With the above-described arrangement, the antenna apparatus having three resonance frequencies F1, F2 and F3 can be constituted. The number of the electrodes and the wave director elements which are placed close to the electrode 411 is not limited to two, and there may be three or more. Moreover, the resonance frequencies F2 and F3 may be set so that F2=F3.

The Other Modified Preferred Embodiments

Figure 50A:
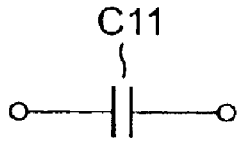
FIG. 50A is a circuit diagram showing one capacitor C11 according to a first implemental example of the reactive elements 31 and 32.
Figure 50B:
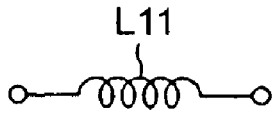
FIG. 50B is a circuit diagram showing one inductor L11 according to a second implemental example of the reactive elements 31 and 32.
Figure 50C:
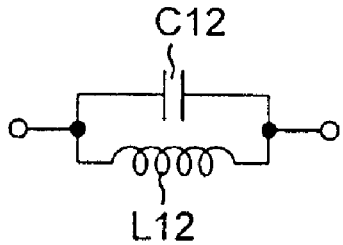
FIG. 50C is a circuit diagram showing a parallel circuit of a capacitor C12 and an inductor L12 according to a third implemental example of the reactive elements 31 and 32.
Figure 50D:
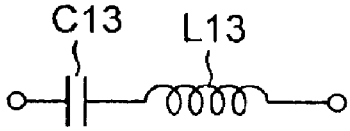
FIG. 50D is a circuit diagram showing a series circuit of a capacitor C13 and an inductor L13 according to a fourth implemental example of the reactive elements 31 and 32.

FIGS. 50A, 50B, 50C and 50D are circuit diagrams showing concrete first through fourth implemental examples of the reactive elements 31 and 32 which are employed in the above-mentioned preferred embodiments. That is, each of the reactive elements 31 and 32 may be constituted by comprising one capacitor C11 as shown in FIG. 50A. Each of the reactive elements 31 and 32 may be constituted by comprising one inductor L11 as shown in FIG. 50B. Furthermore, each of the reactive elements 31 and 32 may be constituted by comprising a parallel circuit of a capacitor C12 and an inductor L12 as shown in FIG. 50C. Furthermore, each of the reactive elements 31 and 32 may be constituted by comprising a series circuit of a capacitor C13 and an inductor L13 as shown in FIG. 50D.

IMPLEMENTAL EXAMPLES

The measurement results of the impedance characteristic and the frequency characteristic of the VSWR measured with a prototype or original top-loading monopole antenna apparatus made by the present inventors will be described below.

Figure 31:
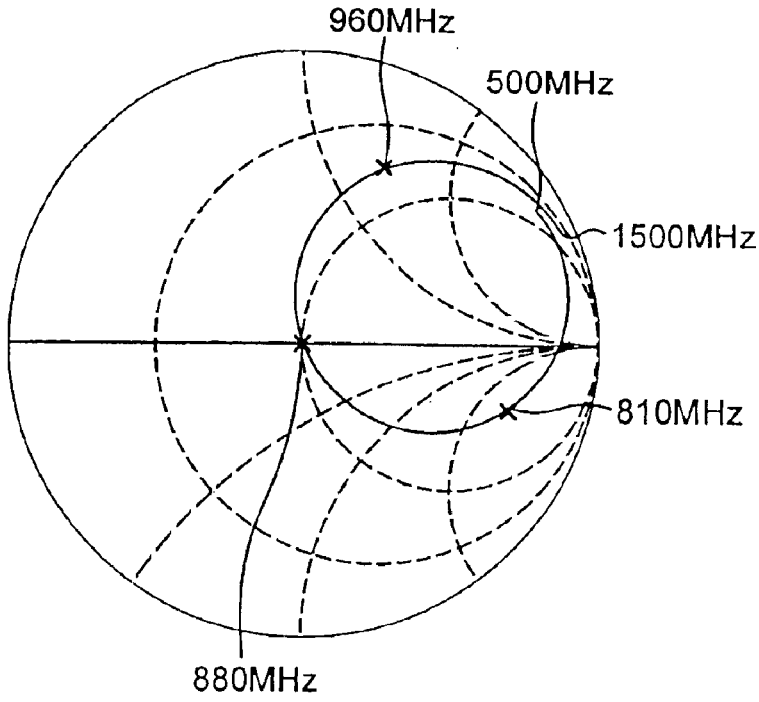
Fig.31 PRIOR ART
FIG. 31 is a Smith chart showing an impedance characteristic of the top-loading monopole antenna apparatus of the prior art of FIG. 39.
Figure 32:
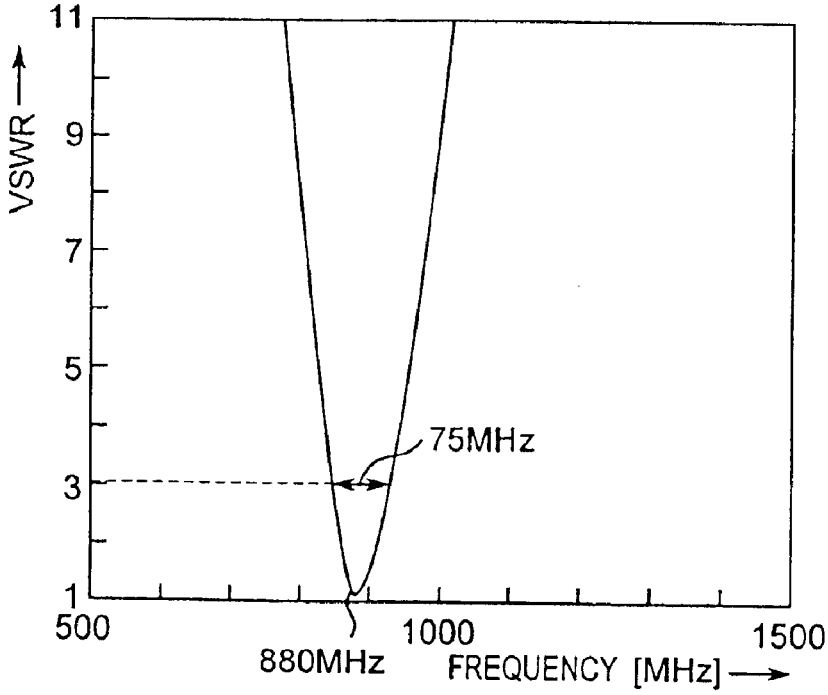
Fig.32 PRIOR ART
FIG. 32 is a graph showing a frequency characteristic of the VSWR of the top-loading monopole antenna apparatus of the prior art of FIG. 39.

FIG. 31 is a Smith chart showing an impedance characteristic of the top-loading monopole antenna apparatus of the prior art of FIG. 39, and FIG. 32 is a graph showing a frequency characteristic of the VSWR of the top-loading monopole antenna apparatus of the prior art of FIG. 39. These characteristics are obtained in the prior art shown in FIG. 39 when the diameter of the electrode 11 is set to 50 mm, the diameter of the grounding conductor 14 is set to 70 mm, and the distance between the linear conductor element 12 and the short-circuit conductor 13 is set to 12 mm. As is apparent from FIG. 32, the operating bandwidth when the VSWR is equal to or smaller than three is 75 MHz, and the ratio of band thereof to the resonance frequency of 880 MHz shown in FIGS. 31 and 32 is 8.4%. Therefore, the antenna apparatus of the prior art has a comparatively narrow operating bandwidth.

Figure 33:
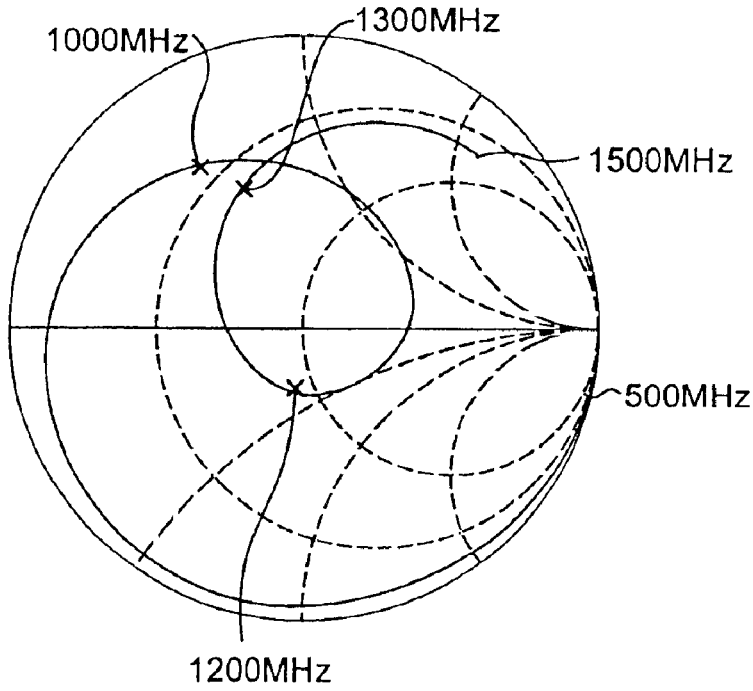
FIG. 33 is a Smith chart showing an impedance characteristic of a top-loading monopole antenna apparatus according to a first implemental example corresponding to the structure of the first preferred embodiment of FIG. 1A.
Figure 34:
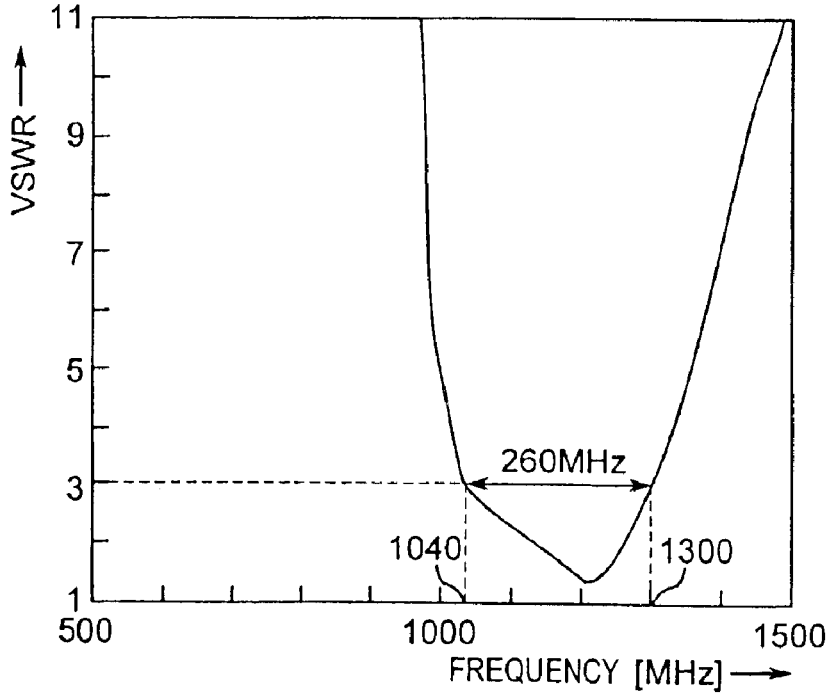
FIG. 34 is a graph showing a frequency characteristic of the VSWR of the top-loading monopole antenna apparatus of the first implemental example corresponding to the structure of the first preferred embodiment of FIG. 1A.

FIG. 33 is a Smith chart showing an impedance characteristic of a top-loading monopole antenna apparatus according to a first implemental example corresponding to the structure of the first preferred embodiment of FIG. 1A, and FIG. 34 is a graph showing a frequency characteristic of the VSWR of the top-loading monopole antenna apparatus of the first implemental example corresponding to the structure of the first preferred embodiment of FIG. 1A. These characteristics are obtained in the first preferred embodiment when the diameter of the electrode 11 is set to 50 mm, the diameter of the grounding conductor 14 is set to 70 mm, the distance between the linear conductor element 12 and the short-circuit conductor 13 is set to 12 mm, the reactive element 31 is a capacitor of 0.5 pF, and the reactive element 32 is a capacitor of 0.5 pF. As is apparent from FIG. 34, the operating bandwidth when the VSWR is equal to or smaller than three is 260 MHz, and the ratio of band thereof to the resonance frequency of 1100 MHz shown in FIGS. 31 and 32 is 23.6%.

Figure 35:
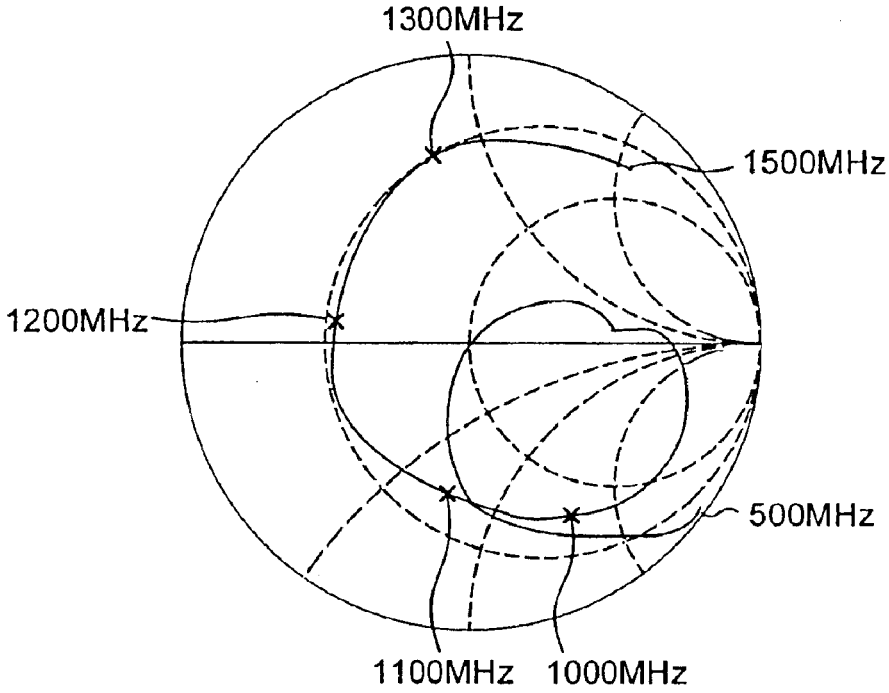
FIG. 35 is a Smith chart showing an impedance characteristic of a top-loading monopole antenna apparatus according to a second implemental example corresponding to the structure of the first preferred embodiment of FIG. 1A.
Figure 36:
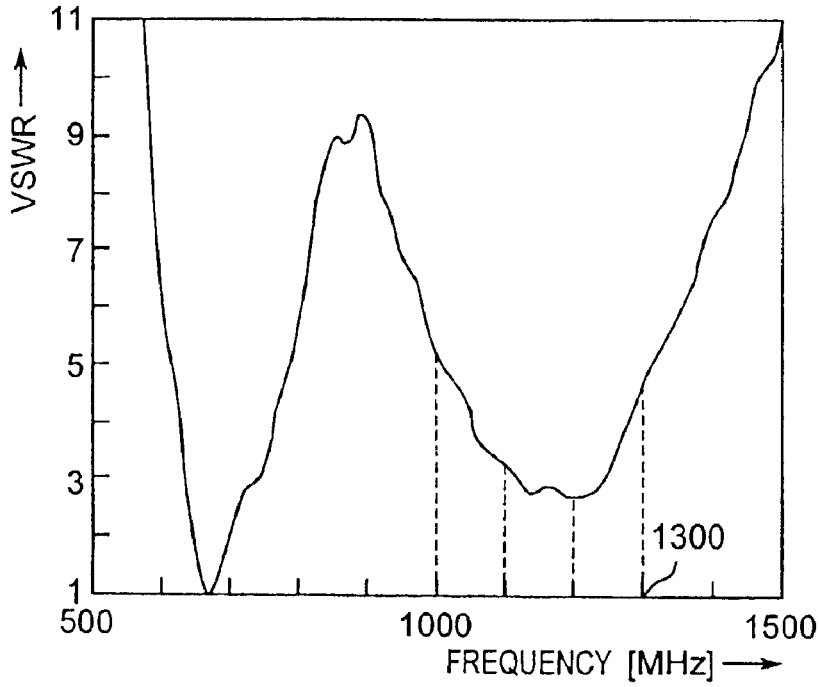
FIG. 36 is a graph showing a frequency characteristic of the VSWR of the top-loading monopole antenna apparatus of the second implemental example corresponding to the structure of the first preferred embodiment of FIG. 1A.

FIG. 35 is a Smith chart showing an impedance characteristic of a top-loading monopole antenna apparatus according to a second implemental example corresponding to the structure of the first preferred embodiment of FIG. 1A, and FIG. 36 is a graph showing a frequency characteristic of the VSWR of the top-loading monopole antenna apparatus of the second implemental example corresponding to the structure of the first preferred embodiment of FIG. 1A. These characteristics are obtained in the first preferred embodiment when the diameter of the electrode 11 is set to 50 mm, the diameter of the grounding conductor 14 is set to 70 mm, the distance between the linear conductor element 12 and the short-circuit conductor 13 is set to 12 mm, the reactive element 31 is a capacitor of 0.5 pF, and the reactive element 32 is a capacitor of 10 pF. As is apparent from FIGS. 35 and 36, it is possessed of two resonance frequencies of a resonance frequency $f_L$=680 MHz and a resonance frequency $f_H$=1200 MHz, and the operating bandwidth at each of the two resonance frequencies is comparatively wide.

Figure 37:
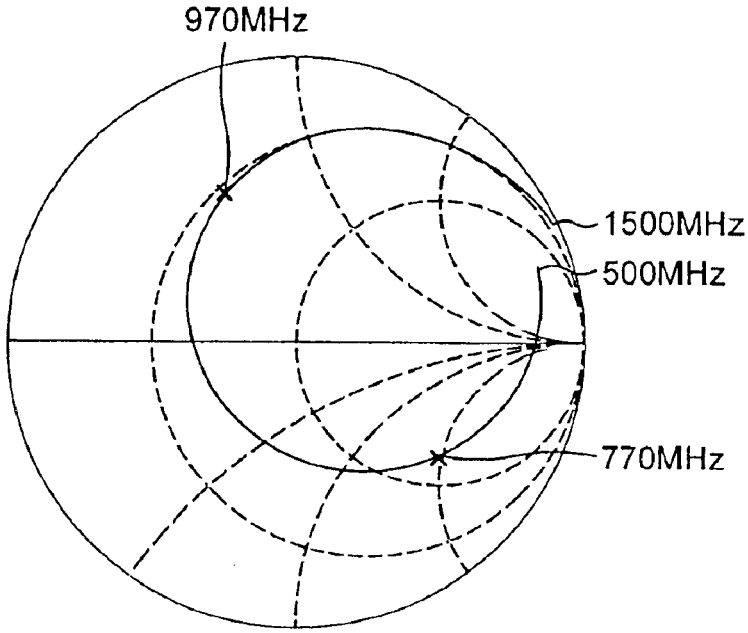
FIG. 37 is a Smith chart showing an impedance characteristic of a top-loading monopole antenna apparatus according to a third implemental example corresponding to the structure of the first preferred embodiment of FIG. 1A.
Figure 38:
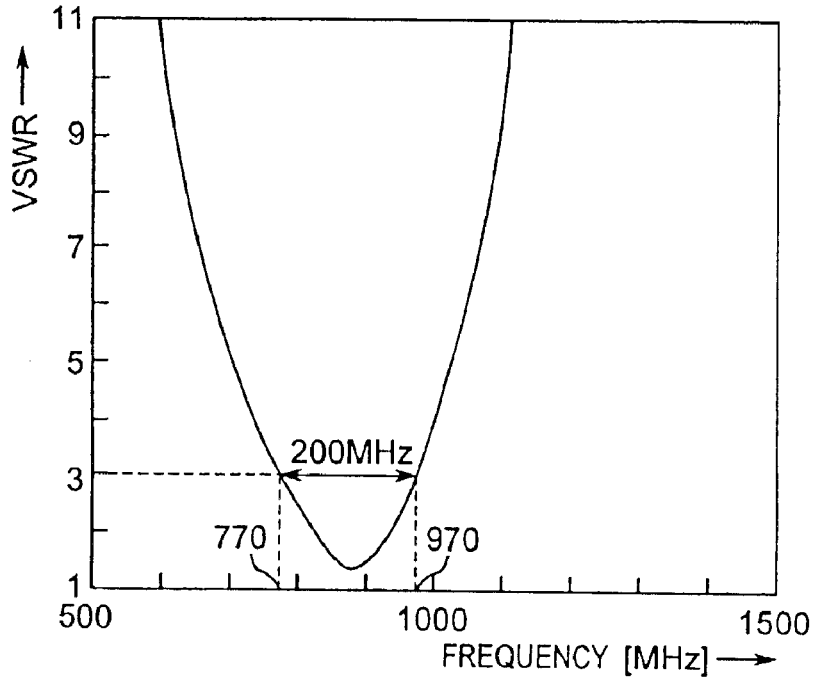
FIG. 38 is a graph showing a frequency characteristic of the VSWR of the top-loading monopole antenna apparatus of the third implemental example corresponding to the structure of the first preferred embodiment of FIG. 1A.

FIG. 37 is a Smith chart showing an impedance characteristic of a top-loading monopole antenna apparatus according to a third implemental example corresponding to the structure of the first preferred embodiment of FIG. 1A, and FIG. 38 is a graph showing a frequency characteristic of the VSWR of the top-loading monopole antenna apparatus of the third implemental example corresponding to the structure of the first preferred embodiment of FIG. 1A. These characteristics are obtained in the first preferred embodiment when the diameter of the electrode 11 is set to 50 mm, the diameter of the grounding conductor 14 is set to 70 mm, the distance between the linear conductor element 12 and the short-circuit conductor 13 is set to 12 mm, the reactive element 31 is an inductor of 4.7 mH, and the reactive element 32 is an inductor of 12 mH. As is apparent from FIG. 37, the operating bandwidth when the VSWR is equal to or smaller than three is 200 MHz, and the ratio of band thereof to the resonance frequency of 880 MHz shown in FIGS. 37 and 38 is 22.7%.

Advantageous Effects Of Preferred Embodiments

According to the present invention described in detail above, there is provided a top-loading monopole antenna apparatus including a grounding conductor, a top-loading electrode, a short-circuit conductor, and a linear conductor element. In this case, the top-loading electrode is provided so as to oppose the grounding conductor, the short-circuit conductor electrically connects the top-loading electrode through a first reactive element with the grounding conductor, and/or the linear conductor element electrically connects the feeding point through a second reactive element with the top-loading electrode.

Accordingly, the present invention includes the following unique advantageous effects.

(1) By providing the first and second reactive elements and by adjusting the respective reactance values thereof, the antenna apparatus can be constituted with a height that is lower than that of the prior art, and impedance matching can be achieved.

(2) By providing the first and second reactive elements and by adjusting the respective reactance values thereof, the antenna apparatus can be constituted with a height that is lower than that of the prior art, and the size of the top-loading electrode can be prevented from increasing.

(3) By providing the first and second reactive elements and by adjusting the respective reactance values thereof, the antenna apparatus can be constituted with a height that is lower than that of the prior art, and a wider bandwidth can be obtained.

(4) By providing the first and second reactive elements and by adjusting the respective reactance values thereof, there can be provided a top-loading monopole antenna apparatus which is capable of being reduced in size and weight, as compared with those of the prior art, and which is suitable for being installed in a mobile body such as a vehicle, a ship, a boat, an airplane or the like.

Moreover, according to another aspect of the present invention, a top-loading monopole antenna apparatus having a feeding point is provided with a first top-loading electrode, a linear feeding element, a second top-loading electrode, and a linear parasitic element. In this case, the first top-loading electrode is provided so as to oppose the grounding conductor, and the linear feeding element electrically connects the feeding point with the first electrode. The second electrode is provided so as to oppose the grounding conductor, and the linear parasitic element electrically connects the feeding point with the second electrode. Then, the first electrode and the second electrode are adjacently provided so as to be electromagnetically coupled to each other.

Accordingly, there can be provided the top-loading monopole antenna apparatus which is capable of being reduced in size and weight, as compared with those of the prior art, and which has an extremely simple structure as well as a plurality of resonance frequencies.

Although the present invention has been fully described in connection with the preferred embodiments thereof with reference to the accompanying drawings, it is to be noted that various changes and modifications will be apparent to those skilled in the art. Such changes and modifications are to be understood as included within the scope of the present invention as being defined by the appended claims unless they depart therefrom.

What is claimed is:

1. A top-loading monopole antenna apparatus having a feeding point, said top-loading monopole antenna apparatus comprising:

a grounding conductor;

a top-loading electrode provided so as to oppose said grounding conductor;

a linear conductor element for electrically connecting said feeding point with said top-loading electrode;

a short-circuit conductor for electrically connecting said top-loading electrode with said grounding conductor through a reactive element; and a movable top-loading electrode which is movably provided so as to change an effective area of said top-loading electrode and said movable top-loading electrode, said movable top-loading electrode being electrically connected with said top-loading electrode.

2. A top-loading monopole antenna apparatus having a feeding point, said top-loading monopole antenna apparatus comprising:

a grounding conductor;

a top-loading electrode provided so as to oppose said grounding conductor;

a linear conductor element for electrically connecting said feeding point with said top-loading electrode;

a short-circuit conductor for electrically connecting said top-loading electrode with said grounding conductor through a reactive element; and a short-circuit control conductor for electrically connecting an intermediate position located between both ends of said linear conductor element with said grounding conductor.

3. A top-loading monopole antenna apparatus having a feeding point, said top-loading monopole antenna apparatus comprising:

a grounding conductor;

a top-loading electrode provided so as to oppose said grounding conductor;

a linear conductor element for electrically connecting said feeding point with said top-loading electrode;

a short-circuit conductor for electrically connecting said top-loading electrode with said grounding conductor through a reactive element; and a short-circuit control conductor for electrically connecting an intermediate position located between both ends of said short-circuit conductor with said grounding conductor.

4. A top-loading monopole antenna apparatus having a feeding point, said top-loading monopole antenna apparatus comprising:

a grounding conductor;

a top-loading electrode provided so as to oppose said grounding conductor;

a linear conductor element for electrically connecting said feeding point with said top-loading electrode;

a short-circuit conductor for electrically connecting said top-loading electrode with said grounding conductor through a reactive element; and a parasite element provided so as to be parallel to said linear conductor element and said short-circuit conductor, said parasitic element having one end which is electrically connected with said grounding conductor.

5. A top-loading monopole antenna apparatus having a feeding point, said top-loading monopole antenna apparatus comprising:

a grounding conductor;

a top-loading electrode provided so as to oppose said grounding conductor;

a linear conductor element for electrically connecting said feeding point with said top-loading electrode;

a short-circuit conductor for electrically connecting said top-loading electrode with said grounding conductor through a reactive element; and a plurality of parasitic elements provided so as to be parallel to said linear conductor element and said short-circuit conductor, each of said plurality of parasitic elements having one end which is electrically connected with said grounding conductor.

6. A top-loading monopole antenna apparatus having a feeding point, said top-loading monopole antenna apparatus comprising:

a grounding conductor;

a top-loading electrode provided so as to oppose said grounding conductor;

a linear conductor element for electrically connecting said feeding point with said top-loading electrode;

a short-circuit conductor for electrically connecting said top-loading electrode with said grounding conductor through a reactive element; and a parasitic element provided at a position which is located apart by a predetermined distance from an outer edge portion of said top-loading electrode so that a part of said parasitic element extends along the outer edge portion of said top-loading electrode, one end of said parasitic element being electrically connected with said grounding conductor.

7. The top loading monopole antenna apparatus as claimed in claim 6, wherein the part of said parasitic element along the outer edge portion of said top-loading electrode has a length of ¼ wavelength at an operating center frequency of said top-loading monopole antenna apparatus.

8. The top-loading monopole antenna apparatus as claimed in claim 6, further comprising:

at least one set of a set of a plurality of said parasitic elements and a set of a plurality of parasitic elements which are each provided at a position that is located apart by a predetermined distance from an outer edge portion of said top-loading electrode so as to extend along the outer edge portion of said top-loading electrode.

9. A top-loading monopole antenna apparatus having a feeding point, said top-loading monopole antenna apparatus comprising:

a grounding conductor;

a top-loading electrode provided so as to oppose said grounding conductor;

a linear conductor element for electrically connecting said feeding point with said top-loading electrode;

a short-circuit conductor for electrically connecting said top-loading electrode with said grounding conductor through a reactive element; and a parasitic element provided at a position which is located apart by a predetermined distance from an outer edge portion of said top-loading electrode so as to extend along the outer edge portion of said top-loading electrode.

10. The top-loading monopole antenna apparatus as claimed in claim 9, wherein said parasitic element has a length of ½ wavelength at an operating center frequency of said top-loading monopole antenna apparatus.

11. A top-loading monopole antenna apparatus having a feeding point, said top-loading monopole antenna apparatus comprising:

a grounding conductor;

a top-loading electrode provided so as to oppose said grounding conductor;

a linear conductor element for electrically connecting said feeding point with said top-loading electrode through a first reactive element;

a short-circuit conductor for electrically connecting said top-loading electrode with said grounding conductor through a second reactive element; and wherein at least one of said first reactive element and said second reactive element includes a variable capacitance diode, and wherein said top-loading monopole antenna apparatus further comprises a voltage control circuit for generating and applying a bias voltage to said variable capacitance diode.

12. A top-loading monopole antenna apparatus having a feeding point, said top-loading monopole antenna apparatus comprising:

a grounding conductor;

a top-loading electrode provided so as to oppose said grounding conductor;

a linear conductor element for electrically connecting said feeding point with said top-loading electrode through a first reactive element;

a short-circuit conductor for electrically connecting said top-loading electrode with said grounding conductor through a second reactive element; and wherein at least one of said first reactive element and said second reactive element includes a switching diode, and wherein said top-loading monopole antenna apparatus further comprises a voltage control circuit for generating and applying a bias voltage to said switching diode.

13. A mobile communication system comprising:

a radio receiver provided in a mobile body having a front window and a rear window; and a top-loading monopole antenna apparatus having a feeding point;

wherein said top-loading monopole antenna apparatus comprises:

a grounding conductor;

a top-loading electrode provided so as to oppose said grounding conductor;

a linear conductor element for electrically connecting said feeding point with said top-loading electrode;

a short-circuit conductor for electrically connecting said top-loading electrode with said grounding conductor through a reactive element;

wherein said top-loading monopole antenna apparatus is provided on at least one of an inside and outside of said mobile body and is electrically connected with said radio receiver; and wherein, when said top-loading monopole antenna apparatus is provided in the vicinity of either one of the front window and the rear window of said mobile body, said top-loading monopole antenna apparatus is provided so that said short-circuit conductor of said top-loading monopole antenna apparatus is provided so as to be closer to the one of the front window and the rear window than said linear conductor element.

14. A mobile communication system comprising:

a radio receiver provided in a mobile body having a front window and a rear window; and two top-loading monopole antenna apparatuses each having a feeding point, said two top-loading monopole apparatuses being provided in said mobile body;

wherein each of said top-loading monopole antenna apparatuses comprises:

a grounding conductor;

a top-loading electrode provided so as to oppose said grounding conductor;

a linear conductor element for electrically connecting said feeding point with said top-loading electrode;

a short-circuit conductor for electrically connecting said top-loading electrode with said grounding conductor through a reactive element;

wherein said top-loading monopole antenna apparatuses are provided on at least one of an inside and outside of said mobile body and are electrically connected with said radio receiver; and wherein one of said top-loading monopole antenna apparatuses is provided so that said short-circuit conductor of said one top-loading monopole antenna apparatus is closer to the front window than said linear conductor element of said one top-loading monopole antenna apparatus, and another one of said top-loading monopole antenna apparatuses is provided so that said short-circuit conductor of said another one top-loading monopole antenna apparatus is closer to the front window than said linear conductor element of said another one top-loading monopole apparatus.

15. A mobile communication system comprising:

a radio receiver provided in a mobile body having a front window and a rear window; and four top-loading monopole antenna apparatuses each having a feeding point, said four top-loading monopole apparatuses being provided in said mobile body;

wherein each of said top-loading monopole antenna apparatuses comprises:

a grounding conductor;

a top-loading electrode provided so as to oppose said grounding conductor;

a linear conductor element for electrically connecting said feeding point with said top-loading electrode;

a short-circuit conductor for electrically connecting said top-loading electrode with said grounding conductor through a reactive element;

wherein said top-loading monopole antenna apparatuses are provided on at least one of an inside and outside of said mobile body and are electrically connected with said radio receiver; and wherein two of said top-loading monopole antenna apparatuses are provided so that said short-circuit conductors of said two of said top-loading monopole antenna apparatuses are closer to the front window than said linear conductor elements of said two of said top-loading monopole antenna apparatuses, respectively, and the other two of said top-loading monopole antenna apparatuses are provided so that said short-circuit conductors of said other two of said top-loading monopole antenna apparatuses are closer to the front window than said linear conductor elements of said two of said top-loading monopole antenna apparatuses, respectively.

16. A mobile communication system comprising:

a radio receiver provided in a mobile body; and a top-loading monopole antenna apparatus having a feeding point;

wherein said top-loading monopole antenna apparatus comprises:

a grounding conductor;

a top-loading electrode provided so as to oppose said grounding conductor;

a linear conductor element for electrically connecting said feeding point with said top-loading electrode;

a short-circuit conductor for electrically connecting said top-loading electrode with said grounding conductor through a reactive element;

wherein said top-loading monopole antenna apparatus is provided on at least one of an inside and outside of said mobile body and is electrically connected with said radio receiver; and wherein a recess portion is formed in said mobile body, wherein said top-loading monopole antenna apparatus is provided in said recess portion, and wherein an opening of said recess portion is covered with a radome.

17. A top-loading monopole antenna apparatus having a feeding point, said top-loading monopole antenna apparatus comprising:

a grounding conductor;

a first top-loading electrode provided so as to oppose said grounding conductor;

a linear feeding element for electrically connecting said feeding point with said first top-loading electrode;

a second top-loading electrode provided so as to oppose said grounding conductor;

a linear parasitic element for electrically connecting said feeding point with said second top-loading electrode; and at least one reactive element inserted at least at one of a connection point between said linear parasitic element and said first top-loading electrode and a connection point between said linear parasitic element and said second top-loading electrode;

wherein said first top-loading electrode and said second top-loading electrode are provided adjacently so as to be electromagnetically coupled to each other.

18. The top-loading monopole antenna apparatus as claimed in claim 17, wherein said reactive element includes any one of:

one capacitor;

one inductor;

a parallel circuit of a capacitor and an inductor; and a series circuit of a capacitor and an inductor.

19. A top-loading monopole antenna apparatus having a feeding point, said top-loading monopole antenna apparatus comprising:

a grounding conductor;

a first top-loading electrode provided so as to oppose said grounding conductor;

a linear feeding element for electrically connecting said feeding point with said first top-loading electrode;

a second top-loading electrode provided so as to oppose said grounding conductor;

a linear parasitic element for electrically connecting said feeding point with said second top-loading electrode; and a parasitic element having one end opened and another end electrically connected with said grounding conductor;

wherein said first top-loading electrode and said second top-loading electrode are provided adjacently so as to be electromagnetically coupled to each other.

20. A top-loading monopole antenna apparatus having a feeding point, said top-loading monopole antenna apparatus comprising:

a grounding conductor;

a first top-loading electrode provided so as to oppose said grounding conductor; a linear feeding element for electrically connecting said feeding point with said first top-loading electrode;

a second top-loading electrode provided so as to oppose said grounding conductor;

a linear parasitic element for electrically connecting said feeding point with said second top-loading electrode; and a short-circuit control element having one end electrically connected with said linear parasitic element and another end electrically connected with said grounding conductor;

wherein said first top-loading electrode and said second top-loading electrode are provided adjacently so as to be electromagnetically coupled to each other.

* * * * *

UNITED STATES PATENT AND TRADEMARK OFFICE

CERTIFICATE OF CORRECTION

PATENT NO. : 6,917,341 B2
DATED : July 12, 2005
INVENTOR(S) : Hirotaka Ishihara et al.

It is certified that error appears in the above-identified patent and that said Letters Patent is hereby corrected as shown below:

Column 33,
Line 44, replace “parasite” with -- parasitic -- after “a” and before “element”.

Column 37,
Line 30, delete “;” after “eletrode”.

Signed and Sealed this

Twenty-fourth Day of January, 2006

JON W. DUDAS
*Director of the United States Patent and Trademark Office*